US008707882B2

(12) United States Patent
Rijken et al.

(10) Patent No.: US 8,707,882 B2
(45) **Date of Patent: *Apr. 29, 2014**

(54) OFFSHORE PLATFORM WITH OUTSET COLUMNS

(75) Inventors: Oriol R. Rijken, Houston, TX (US); Xiaoqiang Bian, Katy, TX (US); Edward Sean Large, Houston, TX (US); Steven John Leverette, Richmond, TX (US)

(73) Assignee: Seahorse Equipment Corp, Houston, TX (US)

( * ) Notice: Subject to any disclaimer, the term of this patent is extended or adjusted under 35 U.S.C. 154(b) by 37 days.

This patent is subject to a terminal disclaimer.

(21) Appl. No.: 13/468,738

(22) Filed: May 10, 2012

(65) Prior Publication Data

US 2013/0000541 A1 Jan. 3, 2013

Related U.S. Application Data

(63) Continuation-in-part of application No. 13/175,502, filed on Jul. 1, 2011.

(51) Int. Cl.
*B63B 35/44* (2006.01)

(52) U.S. Cl.
USPC ..... 114/265

(58) Field of Classification Search
USPC ..... 114/264–266
See application file for complete search history.

(56) References Cited

U.S. PATENT DOCUMENTS

| | | | |
|---|---|---|---|
| 3,837,309 | A | 9/1974 | Biewer |
| 3,982,401 | A | 9/1976 | Loggins |
| 4,169,424 | A | 10/1979 | Newby et al. |
| 4,340,322 | A | 7/1982 | Springett et al. |
| 4,585,373 | A | 4/1986 | Collipp |
| 4,626,137 | A | 12/1986 | Willemsz |
| 4,723,875 | A | 2/1988 | Sutton |
| 4,829,928 | A | 5/1989 | Bergman |
| 4,850,744 | A | 7/1989 | Petty et al. |
| 4,864,958 | A | 9/1989 | Belinsky |
| 4,906,139 | A | 3/1990 | Chiu et al. |
| 5,012,756 | A | 5/1991 | Kristensen |
| 5,558,467 | A | 9/1996 | Horton |
| 5,707,178 | A | 1/1998 | Srinivasan |
| 6,024,040 | A | 2/2000 | Thomas |
| 6,347,912 | B1 | 2/2002 | Thomas |
| 6,431,167 | B1 | 8/2002 | Gonda et al. |

(Continued)

FOREIGN PATENT DOCUMENTS

| | | | |
|---|---|---|---|
| EP | 0441413 | A1 | 8/1991 |
| WO | 2008019067 | A2 | 2/2008 |
| WO | 20100074693 | A1 | 7/2010 |

*Primary Examiner* — Stephen Avila
(74) *Attorney, Agent, or Firm* — Wong, Cabello, Lutsch, Rutherford & Brucculeri LLP.

(57) ABSTRACT

A hull, suitable for use as a tension leg platform (TLP) or as a semi-submersible vessel, comprises four columns arranged in a rectangular planform with each column having a generally polygonal transverse cross section at least one axis of which is generally disposed at a 45-degree angle to a line between the center points of adjacent columns. Buoyant, subsurface pontoons interconnect adjacent columns. The pontoons are generally rectangular in cross section and the outboard, generally vertical surface of each pontoon is connected to a side surface of an adjoining column at a location which is substantially inboard of the outermost face of the column. In certain embodiments of the invention, tendon porches (configured to receive the upper tendon connectors of a TLP) are mounted to the outboard surface of one or more pontoons.

53 Claims, 16 Drawing Sheets

(56) References Cited

U.S. PATENT DOCUMENTS

| | | | |
|---|---|---|---|
| 6,447,208 | B1 | 9/2002 | Huang et al. |
| 6,478,511 | B1 | 11/2002 | Hudson et al. |
| 6,652,192 | B1 | 11/2003 | Xu et al. |
| 6,718,901 | B1 | 4/2004 | Abbott et al. |
| 7,140,317 | B2 | 11/2006 | Wybro et al. |
| 7,462,000 | B2 | 12/2008 | Leverette et al. |
| 7,854,570 | B2 | 12/2010 | Heidari |
| 7,891,909 | B2 | 2/2011 | Tahar et al. |
| 2002/0069810 | A1 | 6/2002 | Min et al. |
| 2004/0040487 | A1 | 3/2004 | Kristensen et al. |
| 2004/0208707 | A1 | 10/2004 | Huang et al. |
| 2005/0084336 | A1 | 4/2005 | Xu et al. |
| 2006/0260526 | A1 | 11/2006 | Kristensen et al. |
| 2010/0074693 | A1 | 3/2010 | Leverette et al. |
| 2010/0315788 | A1 | 12/2010 | Vanderveen et al. |
| 2011/0206466 | A1 | 8/2011 | Rawles, II et al. |
| 2012/0111256 | A1 | 5/2012 | Xu |

OFFSHORE PLATFORM WITH OUTSET COLUMNS

CROSS-REFERENCE TO RELATED APPLICATIONS

This application is a continuation-in-part of U.S. patent application Ser. No. 13/175,502 filed Jul. 1, 2011, the disclosure of which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

This invention relates to offshore platforms. More particularly, it relates to tension leg platforms (TLPs).

2. Description of the Related Art Including Information Disclosed Under 37 CFR 1.97 and 1.98.

A tension leg platform (TLP) is a vertically moored floating structure typically used for the offshore production of oil and/or gas, and is particularly suited for water depths greater than about 1000 ft.

The platform is permanently moored by tethers or tendons grouped at each of the structure's corners. A group of tethers is called a tension leg. The tethers have relatively high axial stiffness (low elasticity) such that virtually all vertical motion of the platform is eliminated. This allows the platform to have the production wellheads on deck (connected directly to the subsea wells by rigid risers), instead of on the seafloor. This feature enables less expensive well completions and allows better control over the production from the oil or gas reservoir.

A semi-submersible is a particular type of floating vessel that is supported primarily on large pontoon-like structures that are submerged below the sea surface. The operating decks are elevated perhaps 100 or more feet above the pontoons on large steel columns. This design has the advantage of submerging most of the area of components in contact with the sea thereby minimizing loading from wind, waves and currents. Semi-submersibles can operate in a wide range of water depths, including deep water. The unit may stay on location using dynamic positioning (DP) and/or be anchored by means of catenary mooring lines terminating in piles or anchors in the seafloor. Semi-submersibles can be used for drilling, workover operations, and production platforms, depending on the equipment with which they are equipped. When fitted with a drilling package, they are typically called semi-submersible drilling rigs.

The DeepDraftSemi® vessel offered by SBM Atlantia, Inc. (Houston, Tex.) is a semi-submersible fitted with oil and gas production facilities that is suitable for use in ultra deep water conditions. The unit is designed to optimize vessel motions to accommodate steel catenary risers (SCRs).

A variety of TLP and semi-submersible designs are known in the art. The following patents describe various examples.

U.S. Pat. No. 7,462,000 discloses a tension leg platform that includes a deck supported on the upper ends of three or more columns interconnected at the lower ends thereof by horizontally disposed pontoons. The columns are battered inwardly and upwardly from the pontoons to the deck. Tendons connected at the columns anchor the platform to the seabed. The footprints of the base of the battered columns and the tendons are larger than the footprint of the deck supported on the upper ends of the columns.

U.S. Pat. No. 4,585,373 describes a tension leg platform with exterior buoyant columns located outside the normal tension leg platform structure. The exterior columns are designed to decrease the pitch period of the tension leg platform away from the point of concentration of the largest wave spectrum energy encountered at a particular marine location. This modification of the pitch period of the tension leg platform is said to reduce the cyclic fatigue stresses in the tension legs of the platform thereby increasing the useful life of the platform structure.

U.S. Pat. No. 6,024,040 describes an off-shore oil production platform that includes an upper barge above the level of the sea. The barge is connected to a completely submerged hollow lower base by partially submerged vertical connecting legs forming a buoyancy tank. The legs along their submerged height include at least two successive portions. A first portion with solid walls delimits a closed space and forms a buoyancy tank. A second portion with openwork sidewall has an interior space that is open to the surrounding marine environment.

U.S. Pat. No. 6,652,192 describes a heave-suppressed, floating offshore drilling and production platform with vertical columns, lateral trusses connecting adjacent columns, a deep-submerged horizontal plate supported from the bottom of the columns by vertical truss legs, and a topside deck supported by the columns. The lateral trusses connect adjacent columns near their lower end to enhance the structural integrity of the platform. During the launch of the platform and towing in relatively shallow water, the truss legs are stowed in shafts within each column, and the plate is carried just below the lower ends of the columns. After the platform has been floated to the deep water drilling and production site, the truss legs are lowered from the column shafts to lower the plate to a deep draft for reducing the effect of wave forces and to provide heave and vertical motion resistance to the platform. Water in the column shafts is then removed, lifting the platform so that the deck is at the desired elevation above the water surface.

U.S. Pat. No. 3,982,401 describes a semi-submersible marine structure for operation in offshore waters that comprises a work deck which is supported by a buoyant substructure. The substructure includes a separable anchor unit which can be lowered to the floor of the offshore site and thereafter weighted in order to regulate the position of the floating structure. Tensioning lines extending between the anchor and the structure draw the latter downward below its normal floating disposition. Outboard anchor lines are used to locate the structure laterally with respect to its position over a drill site.

U.S. Pat. No. 6,347,912 describes an installation for producing oil from an off-shore deposit that includes a semi-submersible platform, at least one riser connecting the platform to the sea bed, and devices for tensioning the riser. The tensioning devices for each riser include at least one submerged float connected to a point on the main run of the riser for hauling it towards the surface, and a mechanism for hauling the riser. The mechanism is installed on the platform and applied to the top end of the riser.

U.S. Pat. No. 5,558,467 describes a deep water offshore apparatus for use in oil drilling and production in which an upper buoyant hull of prismatic shape has a passage that extends longitudinally through the hull. Risers run through the passage and down to the sea floor. A frame structure connected to the hull bottom and extending downwardly comprises a plurality of vertically arranged bays defined by vertically spaced horizontal water entrapment plates providing open windows around the periphery of the frame structure. The windows provide transparency to ocean currents and to wave motion in a horizontal direction to reduce drag. The frame structure serves to modify the natural period and stability of the apparatus to minimize heave, pitch, and roll motions of the apparatus. A keel assembly at the bottom of the frame structure has ballast chambers for enabling the apparatus to float horizontally and for stabilization of the apparatus against tilting in the vertical position.

U.S. Pat. No. 4,850,744 describes a semi-submersible, deep-drafted platform which includes a fully submersible lower hull, and a plurality of stabilizing columns which extend from the lower hull to an upper hull. At least one column has means adapted to reduce the water plane area within a portion of the dynamic wave zone of the column and to increase the natural heave period of the platform.

U.S. Pat. No. 4,723,875 describes a deep-water support assembly for a jack-up type marine structure that comprises a support base, pile guides in the base through which piles are driven to anchor the support base to a marine floor, a receptacle containing a grouting material and adapted to mate with the jack-up structure for providing an anchoring foundation, and a support structure for supporting the receptacle at a fixed height below the marine surface. In one version, a tension leg support assembly is provided in place of the tower assembly. The tension leg assembly also comprises a support base structure, means for anchoring the support base structure to the marine floor, and receptacle means containing a grouting material and adapted to mate with the jack-up structure for providing an anchoring foundation. However, the receptacle means is provided with ballasting and de-ballasting chambers which permit the receptacle means to be employed as a tension leg platform which can be supported from the base structure by tension cables acting in opposition to the buoyancy forces created by de-ballasting the platform once the cables have been secured to the ballasted receptacle means during assembly.

U.S. Pat. No. 3,837,309 describes a floating offshore device that includes a water tight hull, which is adapted to be ballasted to a submerged stage and, when submerged, retained in position by buoying means that can sway relative to the hull. Structural columns fastened to the vessel extend above the water and support a floatable platform above the water when the device is in operable working position. The platform rests on the vessel when the device is being moved.

U.S. Pat. No. 4,169,424 describes a tension leg buoyancy structure for use in seas exposed to wave action that includes a buoyancy section, an anchor section which rests on the sea bed, and a plurality of parallel tethers connecting the buoyancy section with the anchor section to permit the buoyancy section to move relative to the anchor section. Design parameters are selected such that the natural period of the buoyancy section for linear oscillation in the direction of wave travel, the natural period of the buoyancy section for linear oscillation in a horizontal direction perpendicular to the direction of wave travel, and the natural period of the buoyancy section for rotational oscillation about a vertical axis of the buoyancy section structure are greater than 50 seconds.

U.S. Pat. No. 4,906,139 describes an offshore well test platform system that comprises a submerged buoy restrained below the surface of the water by a plurality of laterally extending, tensioned cables, a platform structure connected to a submerged buoy with an upper portion that extends above the surface of the water, and a flexible riser that connects the well to a well test platform deck above the surface of the water.

U.S. Pat. No. 5,012,756 describes a floating structure with completely or partially submersible pontoons that provide the buoyancy for an offshore drilling platform, with a deck that is located on columns attached to the pontoons. A separate, submerged ballast unit is attached to the pontoons to help stabilize the floating structure and improve its motion in waves. The ballast unit is approximately the same size in the horizontal plane as the extent of the pontoons and is attached to the floating structure at each corner by at least three vertical struts that extend through and below the pontoons. The struts are attached so that they can be connected or removed from a locking device on the top side of the pontoons. At the upper end of the struts, an attachment head is provided which can be connected and removed from a lifting device such as a wire driven by a winch mounted on the platform.

U.S. Pat. No. 4,829,928 describes an ocean platform that has a negatively buoyant pontoon suspended from the balance of the platform to increase the heave resonant period. Tendons suspend the pontoon to a depth where dynamic wave forces do not materially act directly on it in seas of normally occurring periods of up to about 15 seconds but do in seas of periods above about 15 seconds. Columns and an upper pontoon provide buoyancy for the platform.

U.S. Pat. No. 4,864,958 describes an anchored platform of the Ship Waterplane Area Protected (SWAP) type. This platform is of similar design to a SWAP-type free floating platform with the additional elements of a downward extension of a vertical hollow column, tensioned anchor chains, catenary mooring lines and anchors, a foundation including a pontoon, ballast, anchoring arrangements and a well template.

U.S. Pat. No. 5,707,178 describes a tension base for a tension leg platform. A buoyant base is submerged below the water surface and is retained with base tendons to a foundation on the sea floor. The buoyant base is attachable to the mooring tendons of a tension leg vessel positioned above the buoyant base. The buoyant base can be selectively ballasted to control the tension in the base tendons. Additional buoyant bases and connecting tendons can extend the depth of the total structure. Mooring lines can be connected between the buoyant base and the sea floor to limit lateral movement of the buoyant base. The buoyant base creates a submerged foundation which is said to reduce the required length of a conventional tension leg platform. The tension leg platform can be detached from the buoyant base and moved to another location.

U.S. Pat. No. 4,626,137 describes a submerged multi-purpose facility which employs anchored tethers and a balanced buoyant/ballast to keep the facility in location. Drift is controlled by tethering the facility to the sea bottom using one or more cables or other slightly flexible tie-down means.

U.S. Pat. No. 6,478,511 describes a floating system held in position on the sea bed by one or several vertical or nearly vertical tensioned lines made of a material that is not very sensitive to fatigue stresses and the tensioned line or lines are sized in a manner independent of the fatigue phenomena associated with the dynamic behavior of the floating system under the effect of external loadings.

U.S. Pat. No. 4,585,373 describes a pitch period reduction apparatus for tension leg platforms. A tension leg platform is provided with exterior buoyant columns located outside the normal tension leg platform structure. The exterior columns decrease the pitch period of the tension leg platform away from the point of concentration of the largest wave spectrum energy encountered at a particular marine location. Modification of the pitch period of the tension leg platform in this manner is said to reduce the cyclic fatigue stresses in the tension legs of the platform, and thereby increase the useful life of the platform structure.

U.S. Pat. No. 6,431,167 illustrates a variety of offshore platforms of the prior art and additionally describes a tendon-based floating structure having a buoyant hull with sufficient fixed ballast to place the center of gravity of the floating structure below the center of buoyancy of the hull. A support structure coupled to an upper end of the hull supports and elevates a superstructure above the water surface. A soft tendon is attached between the hull and the seafloor. A vertical stiffness of the soft tendon results in the floating structure having a heave natural period of at least twenty seconds.

U.S. Pat. No. 6,718,901 describes an "extendable draft platform" that has a buoyant equipment deck on a buoyant pontoon with elongated legs on the pontoon, each comprising a buoyant float, that extend movably through respective openings in the deck. Chains extending from winches on the deck are reeved through fairleads on the pontoon and connected back to the deck. The chains are tightened to secure the deck to the pontoon for conjoint movement to an offshore location. The chains are loosened and the pontoon and leg floats ballasted so that the pontoon and leg floats sink below the floating deck. The chains are then re-tightened until pawls on the leg floats engage the deck. The buoyancy of at least one of the pontoon and leg floats is increased so that the deck is thereby raised above the surface of the water. The chains are connected to mooring lines around an offshore well site, and the raised deck and submerged pontoon are maintained in a selected position over the site with the winches.

U.S. Patent Publication No. 2005/0084336 A1 describes a deck-to-column connection for an extendable draft platform, a type of deep-draft semi-submersible platform. The extendable draft platform has a deck and buoyancy columns installed in leg wells in the deck for vertical movement from a raised position to a submerged position. A connection arrangement secures the columns to the deck when the columns are in the submerged position. In the connection arrangement, a plurality of first guide elements near the top of each column is engageable by a plurality of complementary second guide elements secured to the deck around each leg well when the column is lowered to its submerged position. A locking mechanism is operable between the columns and the deck when the first guide elements are engaged with the second guide elements. The first and second guide elements may be configured so that the connection between the deck and the columns may be enhanced by over-ballasting the columns and/or by welding the columns to the deck.

U.S. Pat. No. 7,854,570 discloses a pontoonless tension leg platform (TLP) that has a plurality of buoyant columns connected by an above-water deck support structure. The design eliminates the need for subsea pontoons extending between the surface-piercing columns. In certain embodiments, the buoyancy of the columns is increased by the addition of subsea sections of increased diameter (and/or cross-sectional area) to provide the buoyancy furnished by the pontoons of the TLPs of the prior art. A pontoonless TLP has a smaller subsea projected area in both the horizontal and vertical planes than a conventional multi-column TLP of equivalent load-bearing capacity having pontoons between the columns. This reduction in surface area produces a corresponding reduction in the platform's response to ocean currents and wave action and consequently allows the use of smaller and/or less costly mooring systems. Moreover, the smaller vertical projected area results in a shorter natural period which enables a pontoonless TLP according to the invention to be used in water depths where conventional TLPs cannot be used due to their longer natural periods. The absence of pontoons in a multi-column TLP also has the added benefit of providing an unobstructed path for risers to connect with the deck of the platform.

U.S. Pat. No. 6,447,208 describes an extended-base tension leg substructure for supporting an offshore platform where the substructure includes a plurality of support columns disposed about a central axis of the substructure and interconnected by at least one pontoon. Each column comprises an above water and submerged portion. The substructure also includes a plurality of wings or arms radiating from the columns and/or the pontoons, each wing securing at least one tendon extending from a wing to an anchor on the seabed. It is said that the wings minimize translational movement and rotational flex in the substructure reducing fatigue in the tendons and their connections.

U.S. Pat. No. 7,140,317 describes a central pontoon semi-submersible floating platform for use in offshore applications which has a hull configuration that includes vertical support columns, a central pontoon structure disposed inboard of the columns at a lower end thereof, and a deck structure supported at an upper end of the columns. The vertical columns and pontoon structure are constructed substantially of flat plate. The vertical columns are adjoined to the outer periphery of the central pontoon and have a transverse cross sectional shape with a major axis oriented radially outward from a center point of the hull, and a central vertical axis disposed a distance outward from the pontoon outer periphery. Risers can be supported on the inboard or outboard side of the pontoon and extended to the deck, and the structure can be anchored by mooring lines extending along the outboard face of the columns extending radially outward and downward from their lower ends.

BRIEF DESCRIPTION OF THE SEVERAL VIEWS OF THE DRAWING(S)

DETAILED DESCRIPTION OF THE INVENTION

Figure 1:
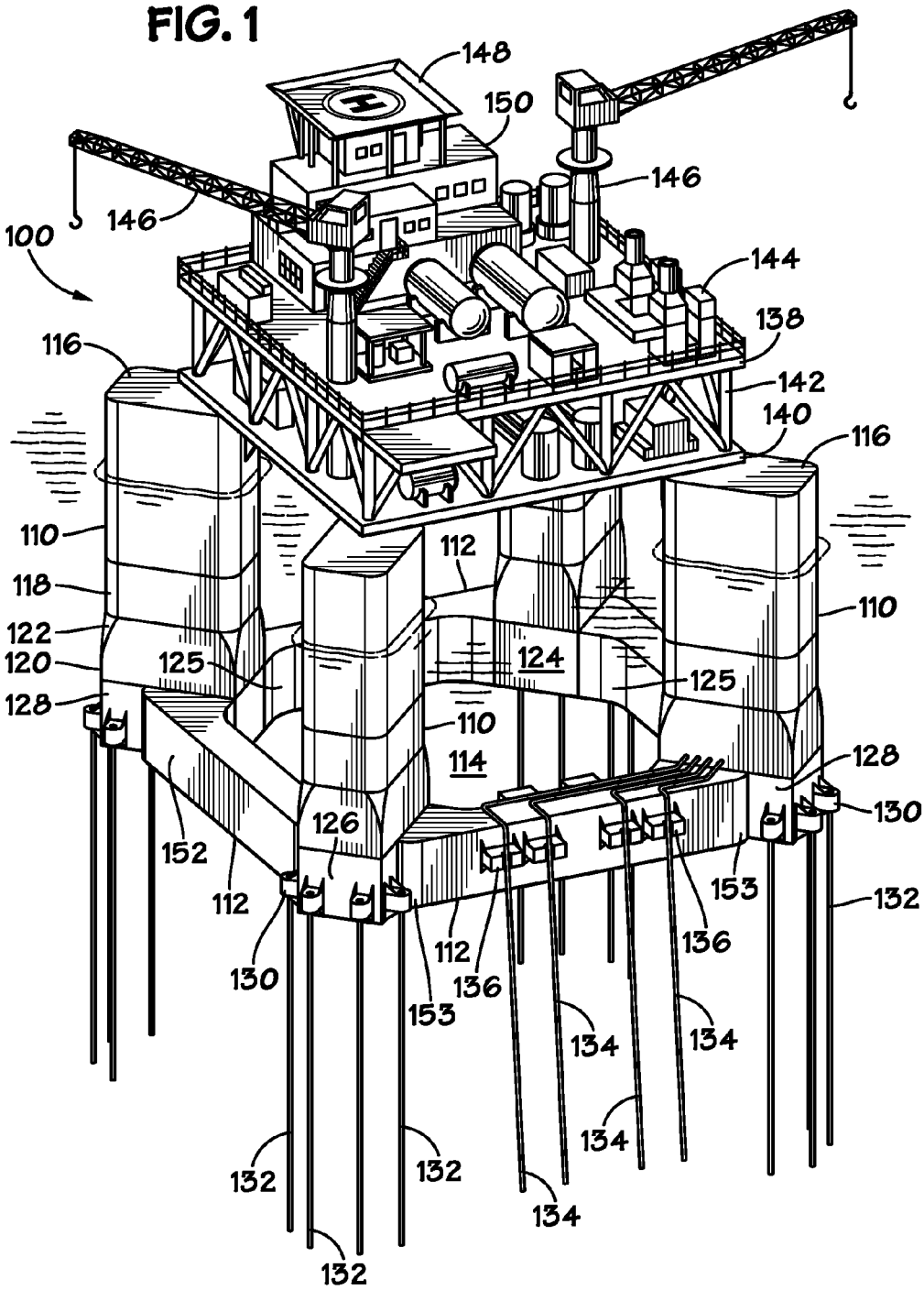
FIG. 1 is an isometric view of a tension leg platform having a hull according to a first embodiment of the invention.

The invention may best be understood by reference to certain illustrative embodiments. FIG. 1 depicts a TLP 100 according to a first embodiment of the invention installed at an offshore location. As is conventional for tension leg platforms, the buoyant hull of the vessel (comprised of columns 110 and pontoons 112) is anchored to the seafloor by tendons 132 which are tensioned to hold the vessel such that the waterline in its installed condition is above the waterline when in its free-floating state. This arrangement eliminates most vertical movement of the structure.

TLP 100 comprises a deck 138 which may be configured to suit the particular needs of the owner or operator. A typical deck layout for an oil and gas production operation is shown in FIG. 1 and includes process equipment 144, helicopter landing facility 148, crew quarters 150 and loading cranes 146. Catenary risers 134 and/or vertical risers (not shown) may be supported by the TLP from riser supports 136 on pontoons 112, columns 110 or deck 138.

Columns 110 have a generally rectangular transverse cross section and are oriented such that the major axis of the transverse cross section is generally aligned with the central axis of the vessel. As shown in the embodiment illustrated in FIG. 1, columns 110 may comprise a plurality of different sections. For example, the lowermost section has straight sides and corners with tendon porches 130 attached to outboard face 126 and adjacent side face 128. Upper sections of column 110 have curved corner sections 118 which connect adjoining side panels and inboard or outboard panels which may be generally flat. Curved sections 118 may have a single radius of curvature, a compound radius of curvature or a generalized curve shape. A transition section of column 110 may join the upper section having curved corners 118 to the lower section having square corners 120 with blending corner piece 122. In certain metocean conditions, columns with curved corner sections may exhibit more favorable hydrodynamic properties in response to waves and currents than columns having only straight corners.

Deck structure 138 extends above upper surface 116 of columns 110. In certain embodiments, deck 138 (or cellar deck 140) may be supported on column upper surface 116 whereas in other embodiments, separate deck support means may be provided, as described more fully, below.

Pontoons 112 interconnect adjacent columns forming a pontoon ring which defines central opening 114. In the embodiment of FIG. 1, inboard face 124 of column 110 is generally flush with the inboard faces of the adjacent pontoons 112. Outboard surface 152 of pontoons 112 intersects side surface 128 of column 110 at a location intermediate inboard face 124 and outboard face 126. One or more curved sections 153 on outboard face 152 and/or inboard face 125 may be incorporated such that there is a generally orthogonal intersection of pontoon 112 with side face 128 of column 110. In the illustrated embodiment, the longitudinal axis of pontoon 112 intersects the base section of column 110 at approximately its midpoint.

Pontoons 112 may comprise a plurality of internal compartments (not shown) which may comprise buoyancy tanks, ballast tanks and/or storage tanks as is conventional in the art.

Deck 138 may be a separate, detachable unit thereby facilitating both fabrication and installation. In certain applications, it has been found advantageous to set the deck on the columns of the TLP using heavy-lift barge cranes subsequent to installation of the hull portion of the structure at the operations site.

Deck support members 142 structurally interconnect upper deck 138 and cellar deck 140. In certain embodiments, the upper deck, cellar deck and deck support members may comprise a truss-type structure. The geometry of the deck need not be the same as that of the hull or of the deck support structure.

The distance between the nominal waterline of the platform in its installed condition and the underside of cellar deck 140 is known as the air gap. This distance is typically selected to exceed the wave height of the platform's design storm so that the platform does not experience a possibly catastrophic uplift force which might occur if waves were allowed to strike the deck.

Figure 2:
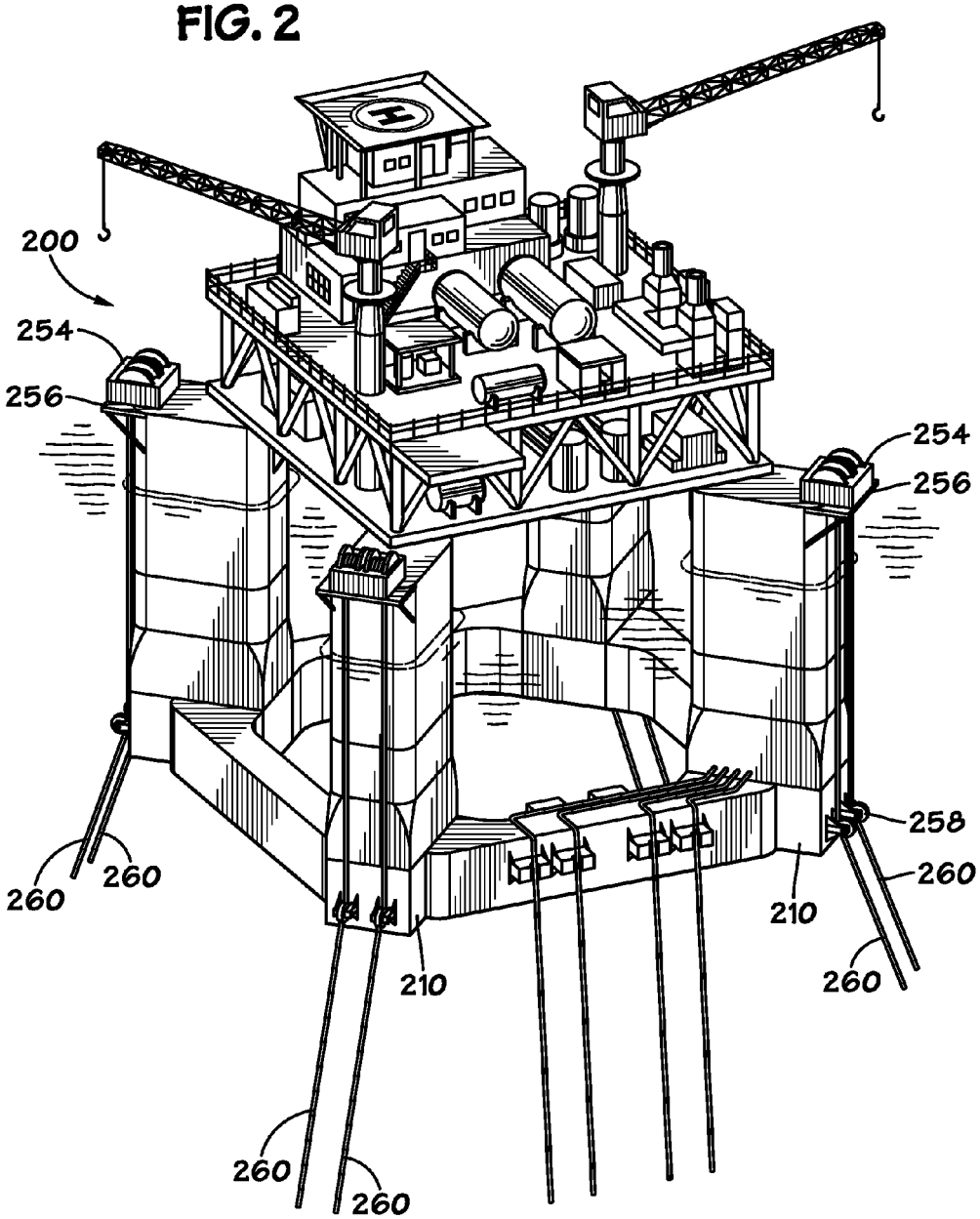
FIG. 2 is an isometric view of a semi-submersible production platform having a hull according to a first embodiment of the invention and a catenary line mooring system.

A second embodiment of the invention is illustrated in FIG. 2. This embodiment is a semi-submersible production vessel 200 moored in position using a plurality of catenary anchor lines 260 which connect to anchoring means in the seafloor (not shown). Anchor lines 260 are routed through fairleads 258 proximate the lower ends of columns 210 and up the outboard face of columns 210 to winches 254 mounted on winch balconies 256. Winches 254 may be used to tension anchor lines 260. In certain situations, winches 254 may be used to selectively adjust the payout and tension of anchor lines 260 so as to effect lateral movement of semi-submersible 200.

The hull of semi-submersible 200 is of the same configuration as that used in TLP 100, illustrated in FIG. 1.

Figure 3:
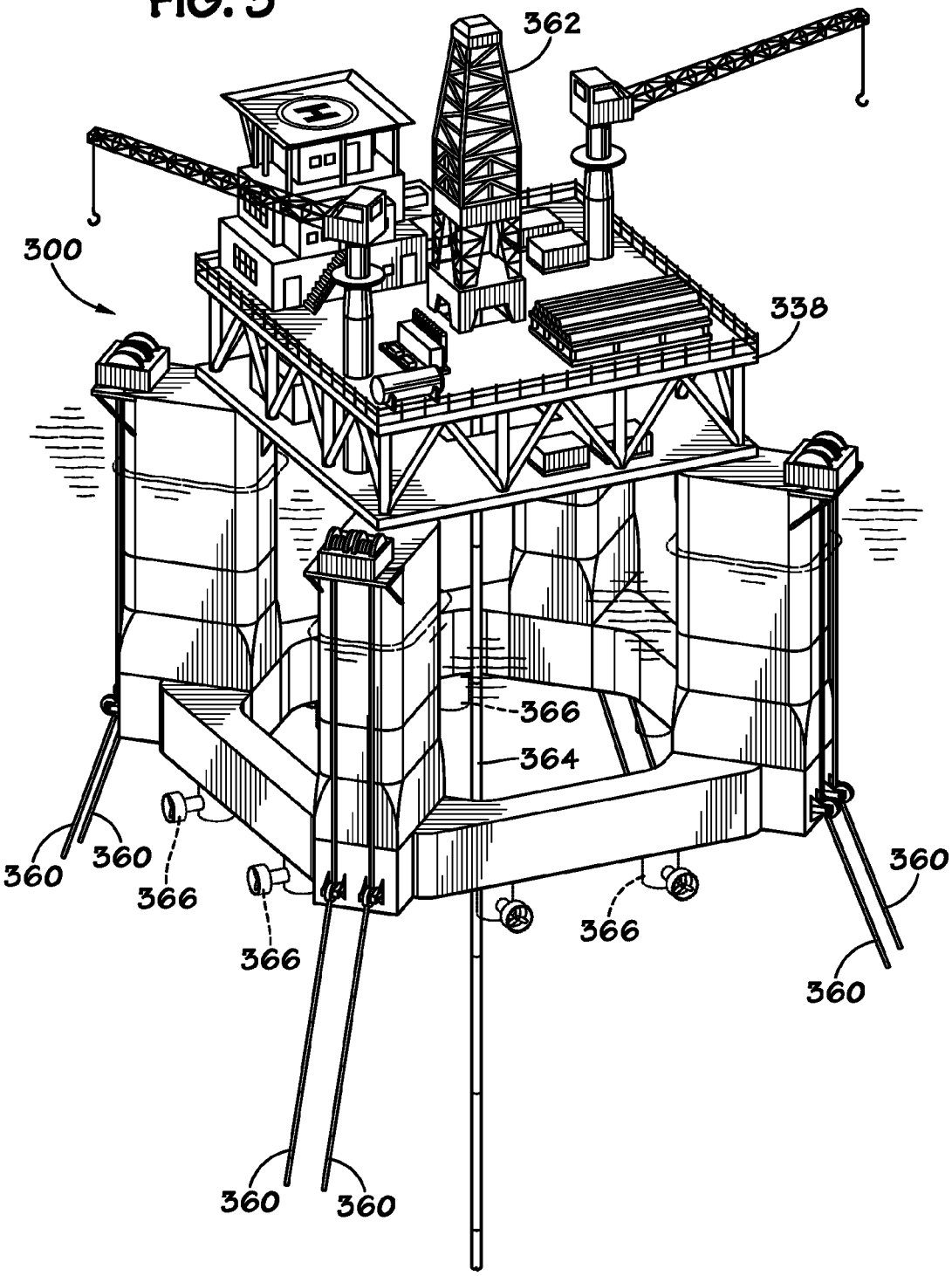
FIG. 3 is an isometric view of semi-submersible drilling rig having a hull according to a first embodiment of the invention and equipped with a catenary line mooring system. The azimuth thrusters of an optional dynamic positioning (DP) system are shown in phantom.

FIG. 3 shows a third embodiment of the invention which is a semi-submersible drilling rig 300. The hull and anchoring means of drilling rig 300 may be substantially the same as those of semi-submersible 200. However, deck 338 is equipped with derrick 362 which may be used to support a drill string contained within vertical riser 364 that connects to a wellhead on the seafloor.

Also shown (in phantom) in FIG. 3 are optional azimuthal thrusters 366 which may be components of a dynamic positioning (DP) system. Dynamic Positioning is a station-keeping system for floating units that uses thrusters to compensate for wind, wave and current forces in a dynamically controlled mode to keep the unit on a predetermined location and heading at sea. A dynamic positioning system may be used in lieu of catenary anchor lines 360.

Figure 4A:
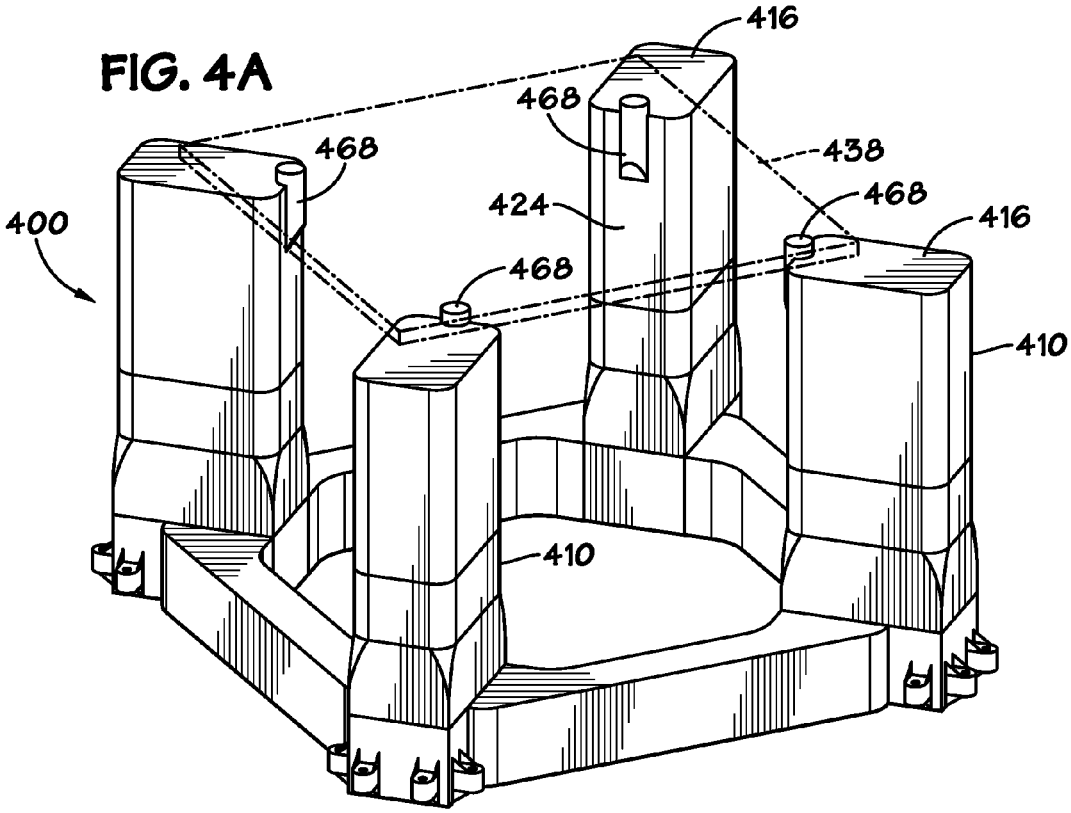
FIG. 4A is an isometric view of a TLP hull according to a first embodiment of the invention.
Figure 4B:
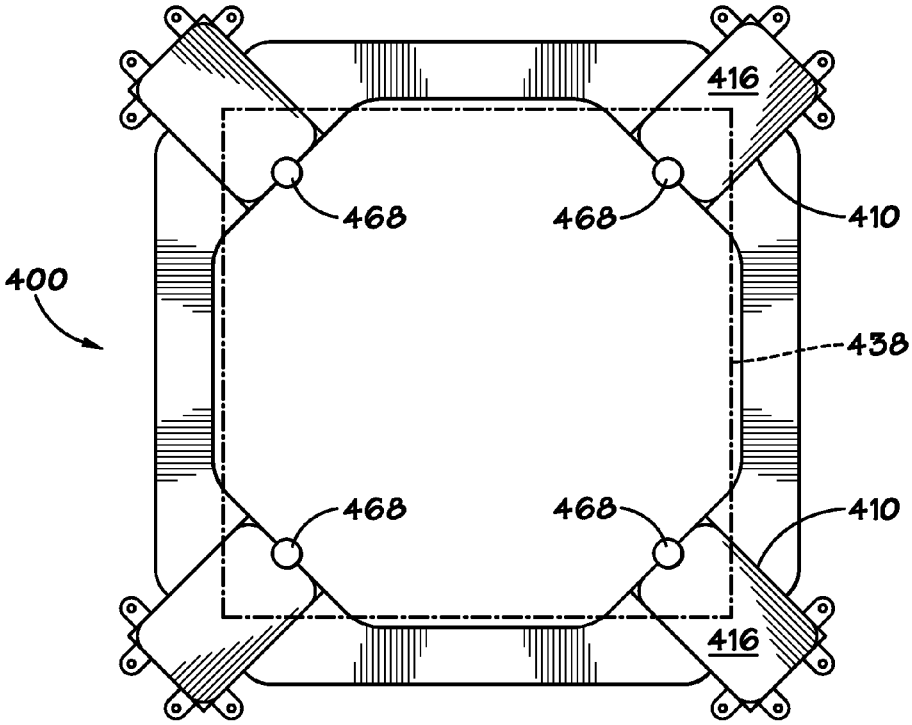
FIG. 4B is a top plan view of the hull illustrated in FIG. 4A.

The hull structure, alone, used in TLP 100 and semi-submersibles 200 and 300 (FIGS. 1, 2 and 3, respectively), is shown in FIGS. 4A and 4B. Visible in FIGS. 4A and 4B are deck support posts 468 which may be used to support a deck structure 438 (shown in phantom) on hull 400.

Deck support posts 468 may connect to both column upper surface 416 and inboard column surface 424 such that column face 424 is a major load-bearing member. In this way, the internal structure of a column may be reduced from that which would be required were deck 438 supported only by upper surface 416.

Figure 5A:
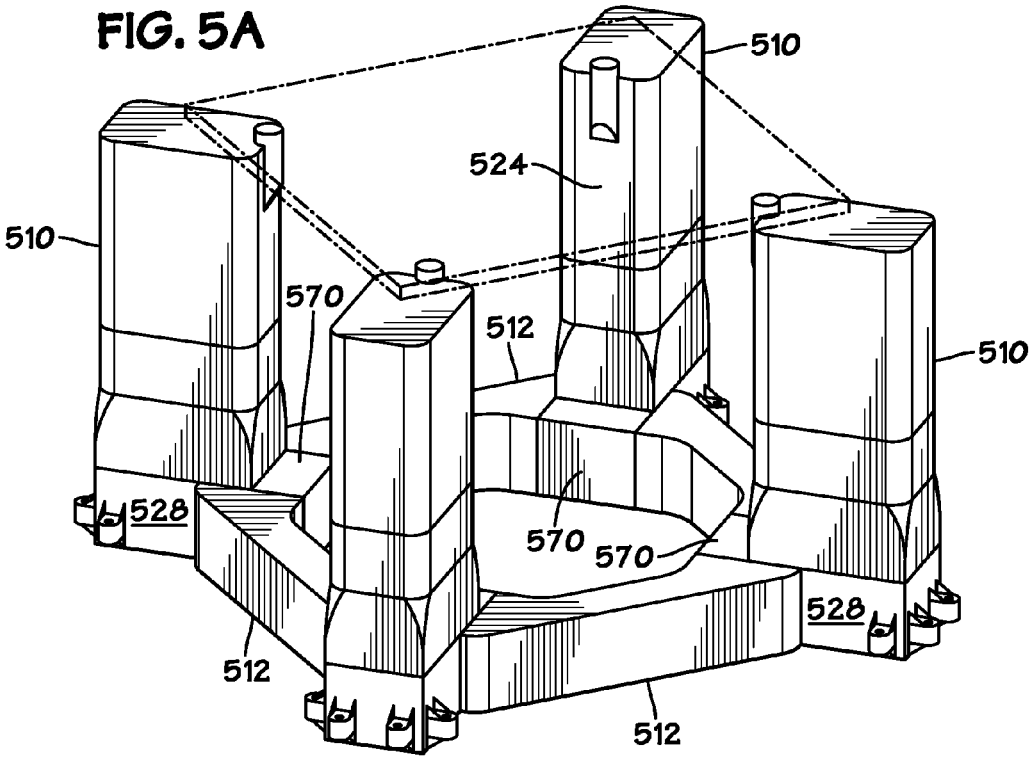
FIG. 5A is an isometric view of a TLP hull according to a second embodiment of the invention.
Figure 5B:
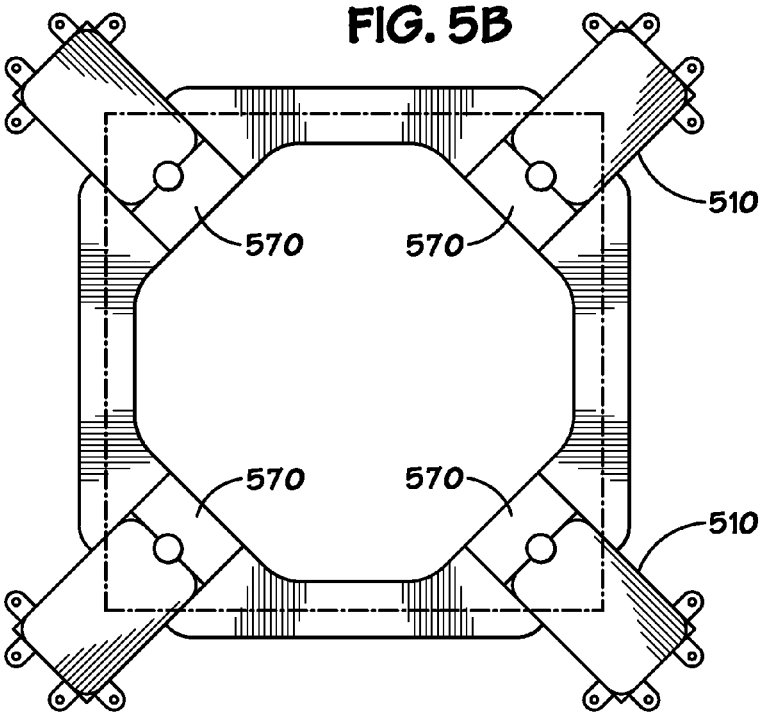
FIG. 5B is a top plan view of the hull illustrated in FIG. 5A.

A second embodiment of the invention is illustrated in FIGS. 5A and 5B. In this embodiment, the pontoon ring extends inboard from the inboard face 524 of columns 510 and includes inner pontoon portions 570 located immediately inboard from the lower portion of inboard face 524 of each column 510. In this embodiment, the longitudinal axis of pontoons 512 intersects side face 528 of columns 510 at a point that is intermediate the midline of column 510 and the juncture of inboard face 524 and side face 528.

Figure 6A:
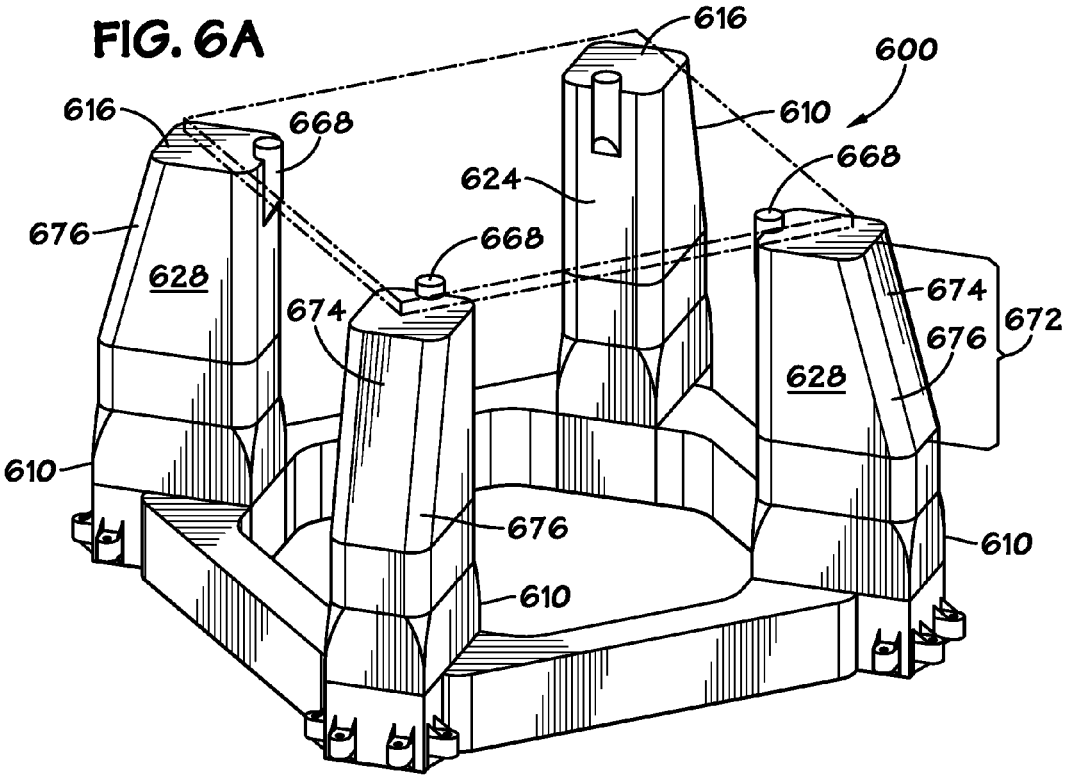
FIG. 6A is an isometric view of a TLP hull according to a third embodiment of the invention.
Figure 6B:
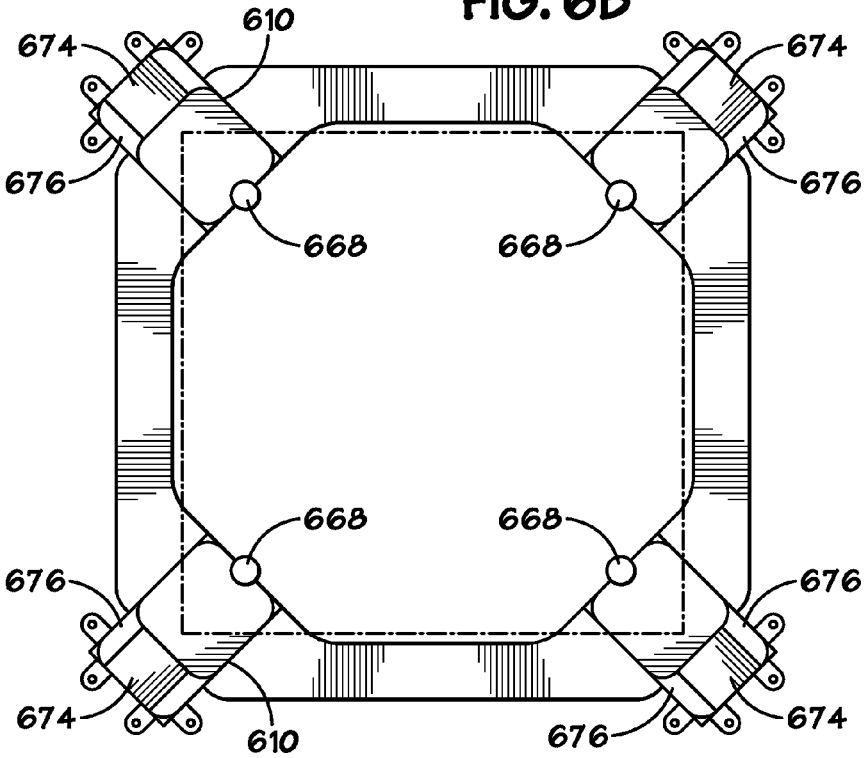
FIG. 6B is a top plan view of the hull illustrated in FIG. 6A.

An embodiment of the invention having tapered columns is illustrated in FIGS. 6A and 6B. Columns 610 have portion 672 wherein the cross sectional area of the column progressively increases with distance from upper surface 616. Inboard face 624 of columns 610 may be substantially the same as inboard face 124 of TLP 100 (as illustrated in FIG. 1) and may be the principal load-bearing member for deck support posts 668. Outside surface 674 may be inclined from the vertical and a curved surface 676 may join outboard surface 674 and side surface 628. The use of tapered columns 610 may allow TLP hull 600 to be constructed using less material than that required for the hull of TLP 100.

Figure 7A:
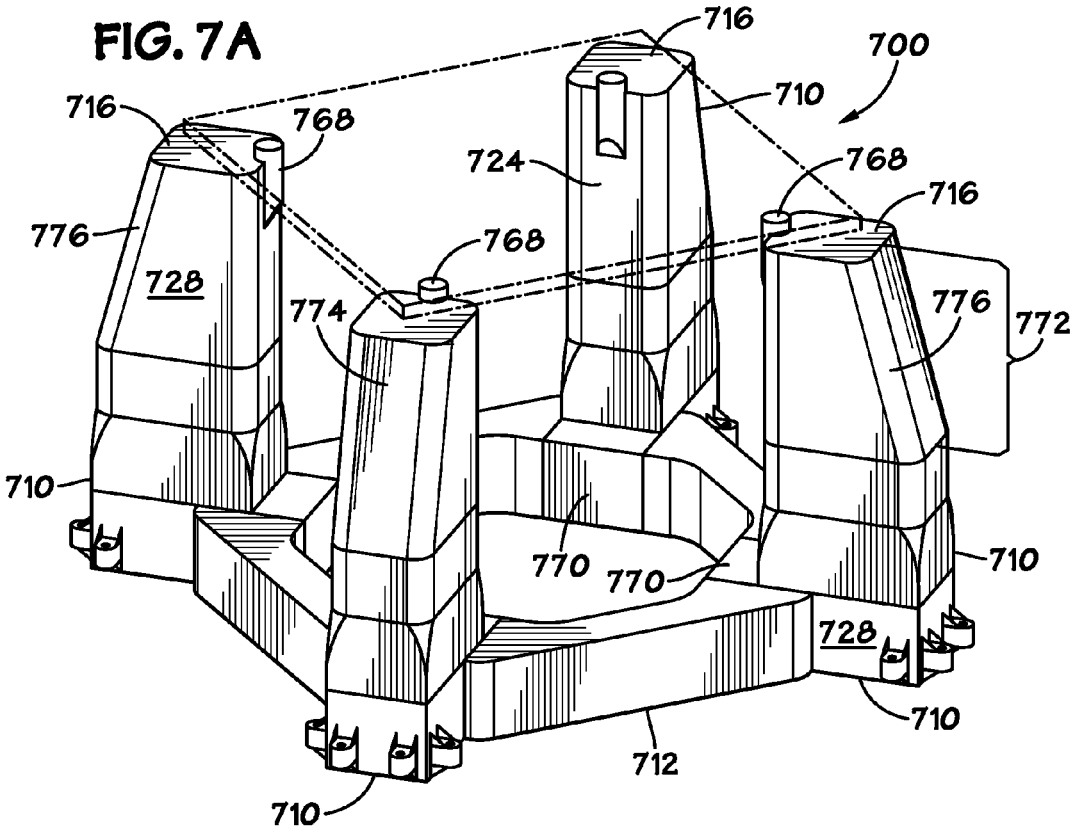
FIG. 7A is an isometric view of a TLP hull according to a fourth embodiment of the invention.
Figure 7B:
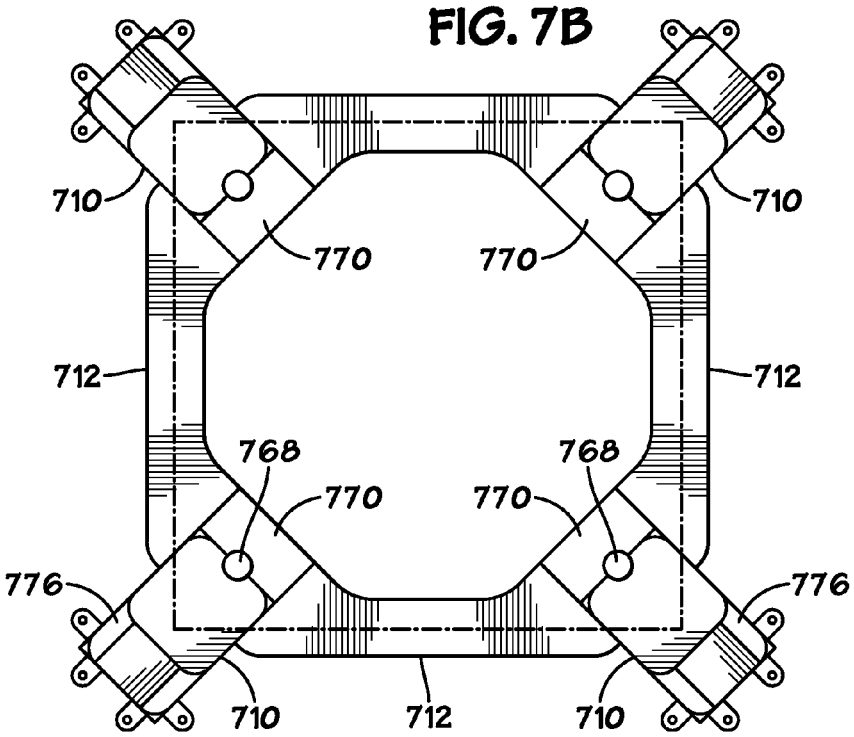
FIG. 7B is a top plan view of the hull illustrated in FIG. 7A.

An embodiment of the invention having the pontoon structure of TLP hull 500 (see FIGS. 5A and 5B) and the tapered column structure of TLP hull 600 (see FIGS. 6A and 6B) is shown in FIGS. 7A and 7B. The pontoon ring extends inboard from the inboard face 724 of columns 710 and includes inner pontoon portions 770 located immediately inboard from the lower portion of inboard face 724 of each column 710. In this embodiment, the longitudinal axis of pontoons 712 intersects side face 728 of columns 710 at a point that is intermediate the midline of column 710 and the juncture of inboard face 724 and side face 728. Columns 710 have portion 772 wherein the cross sectional area of the column progressively increases with distance from upper surface 716. Inboard face 724 of columns 710 may be substantially the same as inboard face 124 of TLP 100 (as illustrated in FIG. 1) and may be the principal load-bearing member for deck support posts 768. Outside surface 774 may be inclined from the vertical and a curved surface 776 may join outboard surface 774 and side surface 728. The use of tapered columns 710 may allow TLP hull 700 to be constructed using less material than that required for TLP hull 500.

Figure 8A:
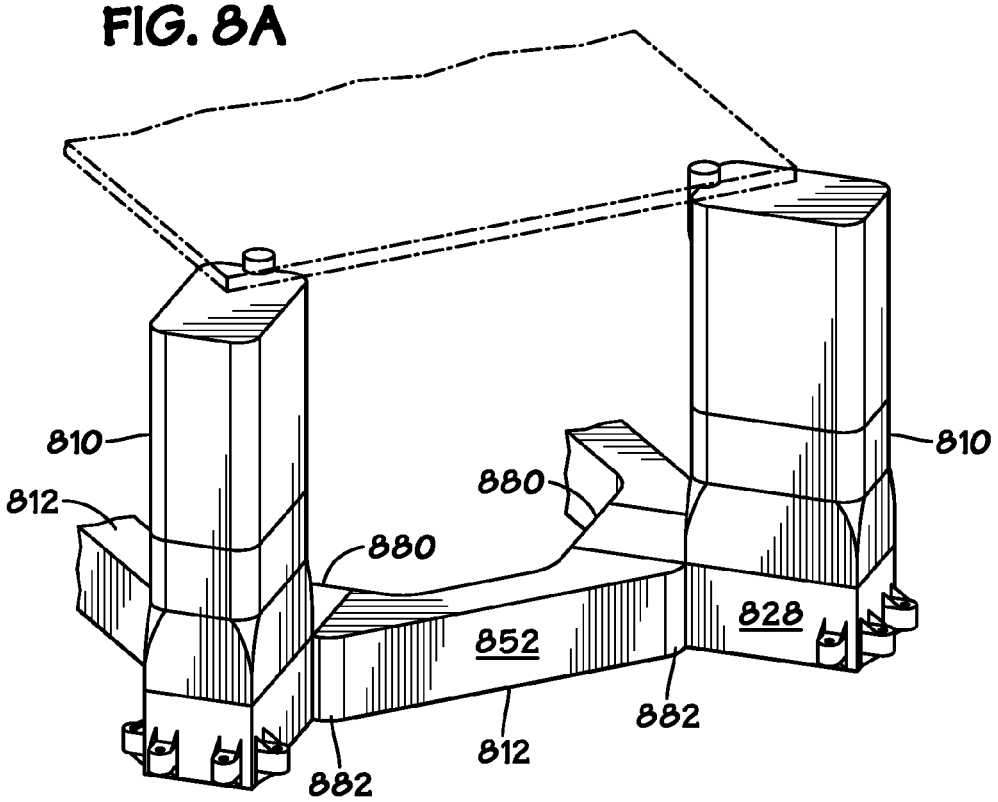
FIG. 8A is an isometric view of a TLP hull according to a fifth embodiment of the invention.
Figure 8B:
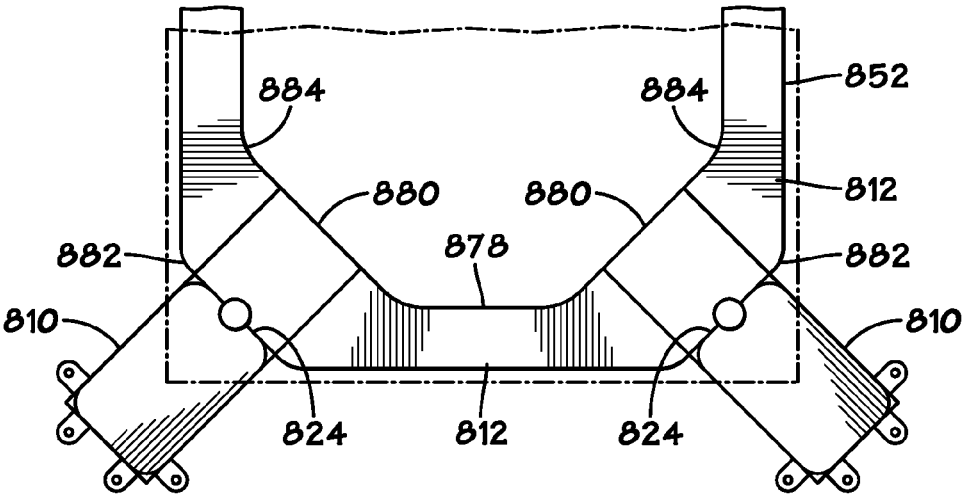
FIG. 8B is a top plan view of the hull illustrated in FIG. 8A.

FIGS. 8A and 8B show an embodiment of the invention wherein the columns 810 are outboard of the pontoon ring. The pontoon ring extends inboard from the inboard face 824 of columns 810 and includes inner pontoon portions 880 located immediately inboard from the lower portion of inboard face 824 of each column 810. The inboard surface 878 of the pontoon ring may include one or more curved sections 884 between adjacent straight sections. In this embodiment, the outboard face 852 of pontoons 812 (which may include curved section 882) intersects columns 810 at the juncture of side face 828 and inboard face 824.

Figure 9A:
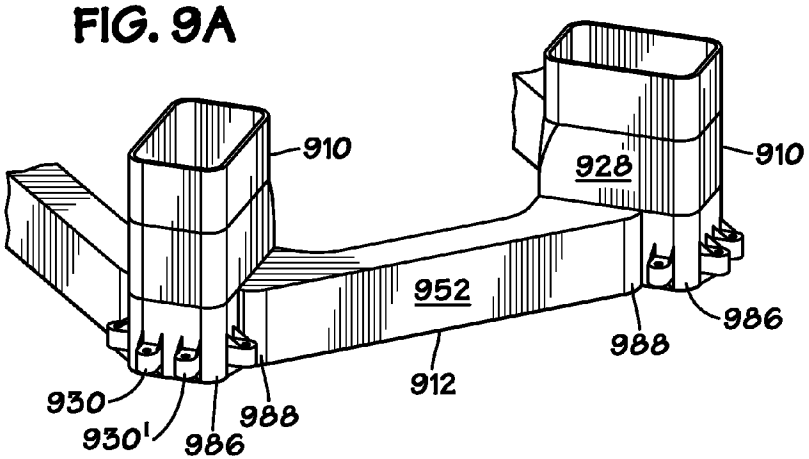
FIG. 9A is a partial, isometric view of a TLP hull according to a sixth embodiment of the invention.
Figure 9B:
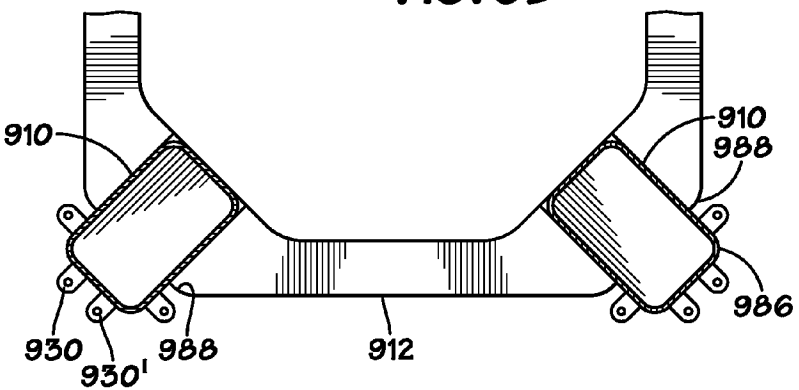
FIG. 9B is a partial, transverse, cross-sectional view of the hull illustrated in FIG. 9A.

A sixth embodiment of the invention is shown in FIGS. 9A and 9B. In this embodiment, columns 910 have a curved corner section 986 which extends to substantially the bottom of the column 910. In this embodiment, tendon porches 930 and 930' may be closer together than in embodiments with column bottom sections having square corners (e.g., the hulls shown in FIGS. 1-4). Curved corner sections 986 may improve the hydrodynamic properties of the hull 900 in response to ocean waves and currents. The outboard surface 952 of pontoons 912 may include curved portions 988 configured such that the intersection of pontoon outboard surface 952 with column side surface 928 is substantially orthogonal.

Figure 10A:
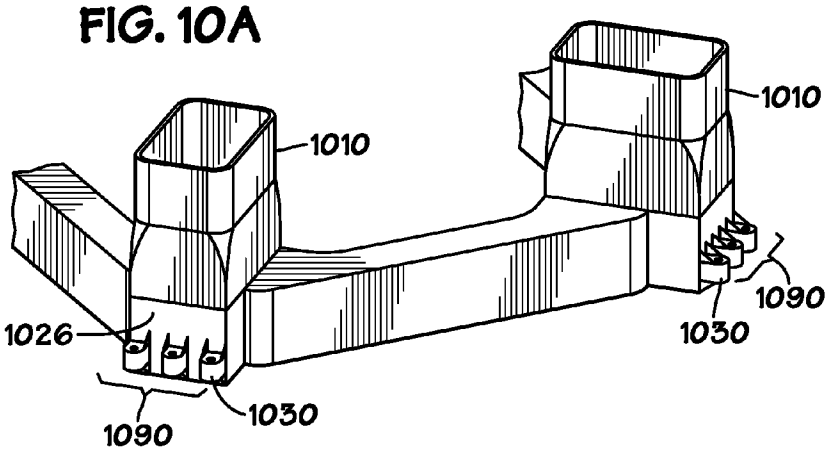
FIG. 10A is a partial, isometric view of a TLP hull according to a seventh embodiment of the invention.
Figure 10B:
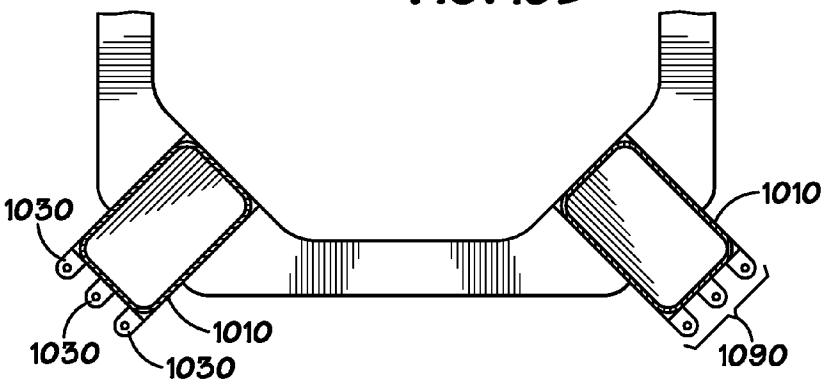
FIG. 10B is a partial, transverse, cross-sectional view of the hull illustrated in FIG. 10A.

A seventh embodiment of the invention, shown in FIGS. 10A and 10B, includes a three-abreast set 1090 of tendon porches 1030 on outboard face 1026 of each column 1010.

Figure 11A:
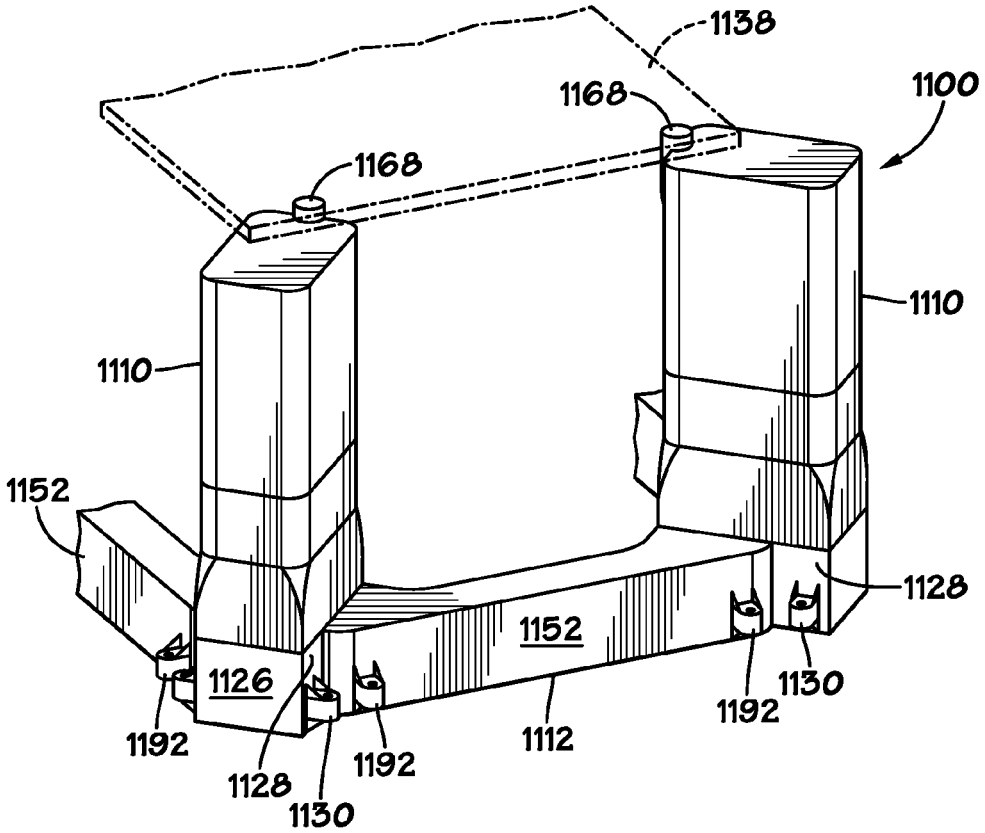
FIG. 11A is a partial, isometric view of a TLP hull according to an eighth embodiment of the invention.
Figure 11B:
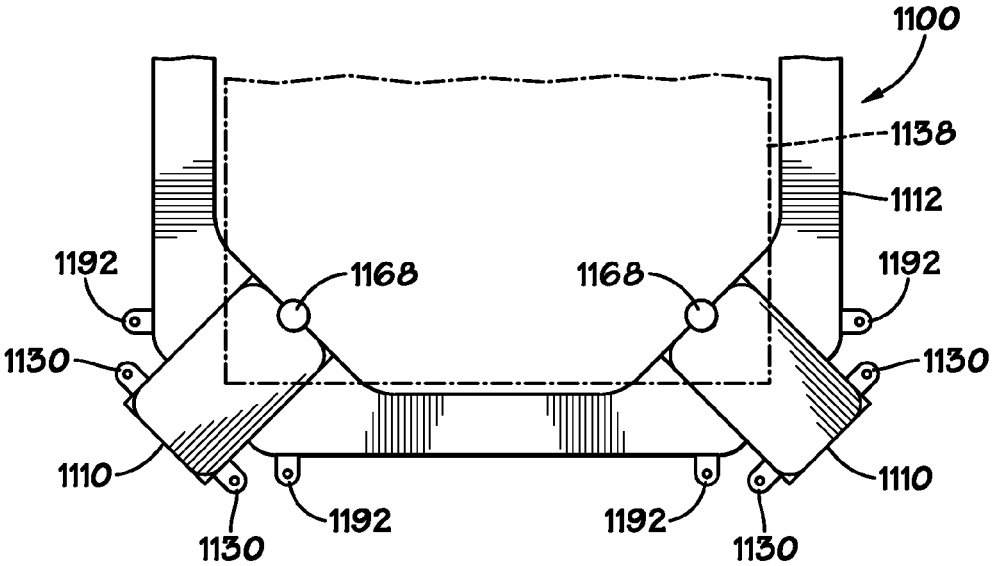
FIG. 11B is a partial, top plan view of the hull illustrated in FIG. 11A.

FIGS. 11A and 11B depict an eighth embodiment of the invention. TLP hull 1100 has the same general configuration as the hulls shown in FIGS. 1-4. However, hull 1100 has pontoon-mounted tendon porches 1192 attached to outboard face 1152 of pontoons 1112. These pontoon-mounted porches 1192 may be in addition to the more conventional column-mounted tendon porches 1130 which are attached to adjacent side face 1128 of columns 1110. Outboard face 1126 of columns 1110 may be devoid of tendon porches, if so desired.

Figure 12A:
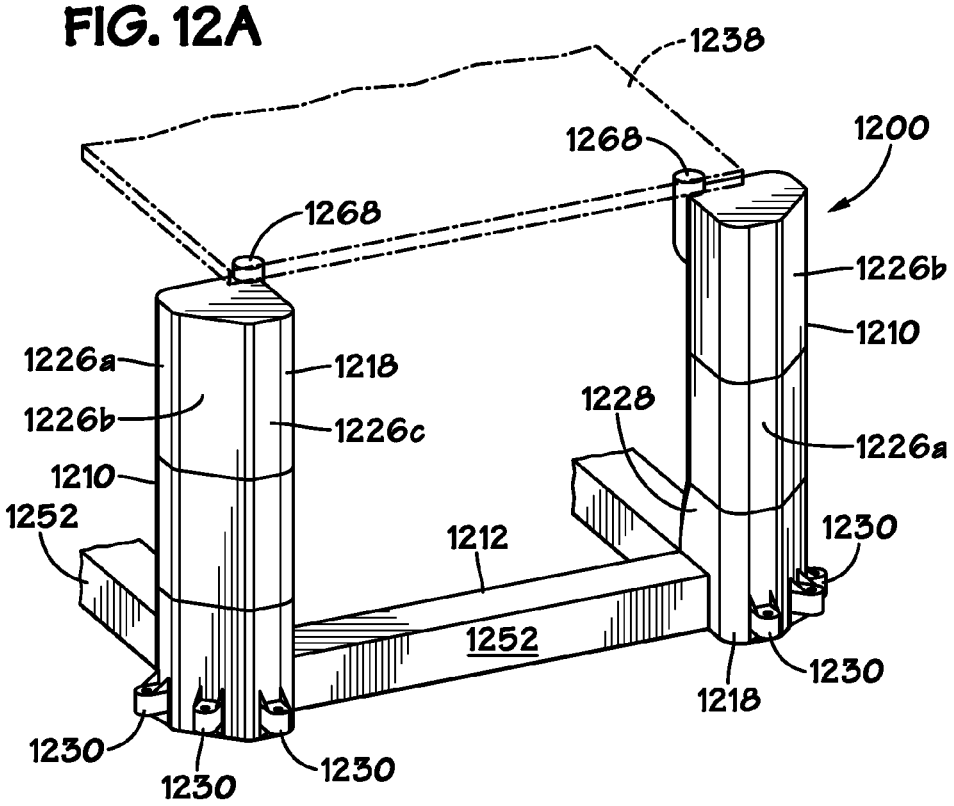
FIG. 12A is a partial, isometric view of a TLP hull according to a ninth embodiment of the invention.
Figure 12B:
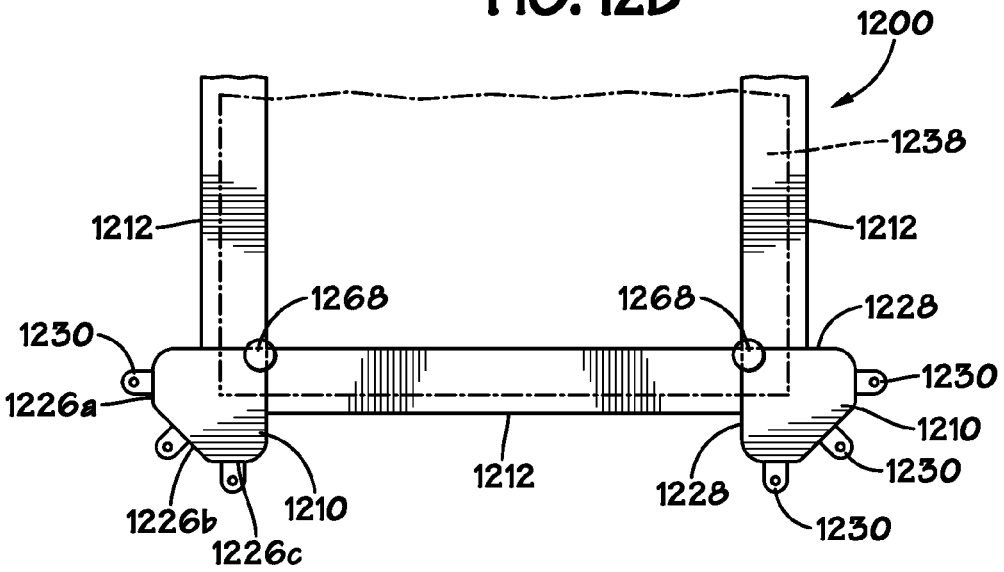
FIG. 12B is a partial, top plan view of the hull illustrated in FIG. 12A.

FIGS. 12A and 12B depict a ninth embodiment of the invention. Unlike the hulls shown in FIGS. 1-4 that have generally rectangular columns, TLP hull 1200 has 5-sided columns 1210 with two, generally orthogonal side surfaces 1228 and three, adjacent outboard surfaces 1226*a*, 1226*b* and 1226*c* connected between the side surfaces. Columns 1210 may have curved corner sections 1218 which connect side panels 1228 and outboard panels 1226*a* or 1226*c* which may be generally flat. Additionally, curved sections 1218 may be used to connect outboard panels 1226*a* to 1226*b* and 1226*b* to 1226*c*. Curved sections 1218 may have a single radius of curvature, a compound radius of curvature or a generalized curve shape.

A plurality of buoyant pontoons 1212 are connected between adjacent columns 1210, the pontoons having a generally rectangular cross section and an outboard, generally vertical surface 1252 connected to a side surface 1228 of an adjacent column at a location that is inboard of the outboard surfaces 1226 of column 1210.

Tendon porches 1230 may be mounted to one or more of outboard surfaces 1226*a*, 1226*b* and/or 1226*c*. In yet other embodiments, tendon porches may be mounted to column side surfaces 1228 outboard of the juncture of column surface 1228 and pontoon surface 1252. Such tendon porches may be in addition to or in lieu of the tendon porches on outboard surfaces 1226*a* and 1226*c* or 1226*b*.

Figure 13A:
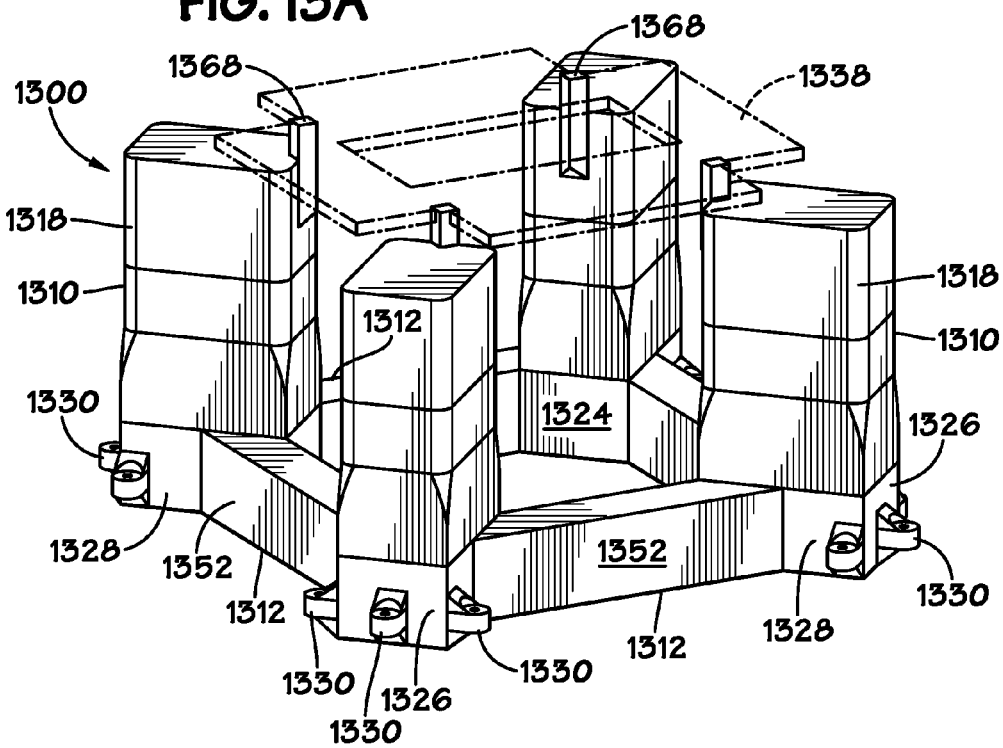
FIG. 13A is an isometric view of a TLP hull according to a tenth embodiment of the invention.
Figure 13B:
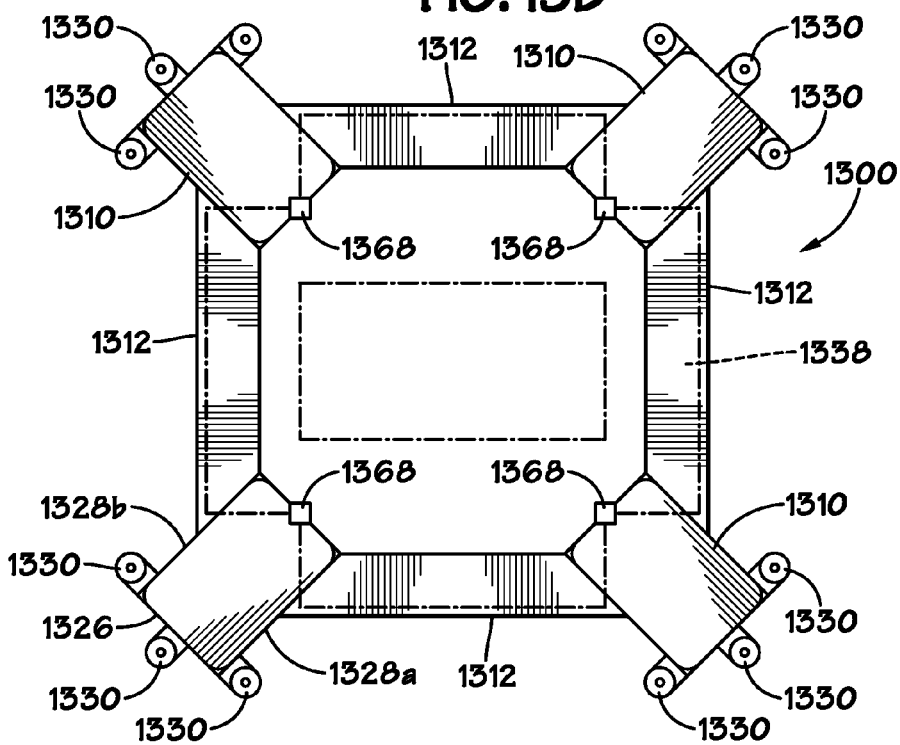
FIG. 13B is a top plan view of the hull illustrated in FIG. 13A.

FIGS. 13A and 13B depict a tenth embodiment of the invention. TLP hull 1300 has rectangular columns 1310 with two, opposing, side surfaces 1328*a* and 1328*b* with outboard surface 1326 and opposing inboard column surface 1324 connected between the side surfaces. Columns 1310 may have curved corner sections 1318 which connect side panels 1328 to outboard panel 1326 and/or inboard panel 1324 which may be generally flat. As shown in the illustrated embodiment, curved corner sections 1318 may be used in the upper portion of columns 1310 while the lower portion has square corners. Curved sections 1318 may have a single radius of curvature, a compound radius of curvature or a generalized curve shape.

A plurality of buoyant pontoons 1312 are connected between adjacent columns 1310, the pontoons having a generally rectangular cross section and an outboard, generally vertical surface 1352 connected to a side surface 1328 of an adjacent column at a location that is inboard of the outboard surface 1326 of column 1310. The inboard surfaces of the pontoons may be flush with the inboard surfaces 1324 of columns 1310. In this embodiment, the pontoons 1312 are comprised of substantially straight sections.

Tendon porches 1330 may be mounted to one or more of outboard column face 1326 and side surfaces 1328*a* and/or 1328*b* outboard of the juncture of column surface 1328 and pontoon vertical surface 1352. It will be appreciated that a TLP according to the present invention permits tendon porches to be located on adjacent faces of a column when a plurality of tendon porches are connected to a single column.

Figure 14:
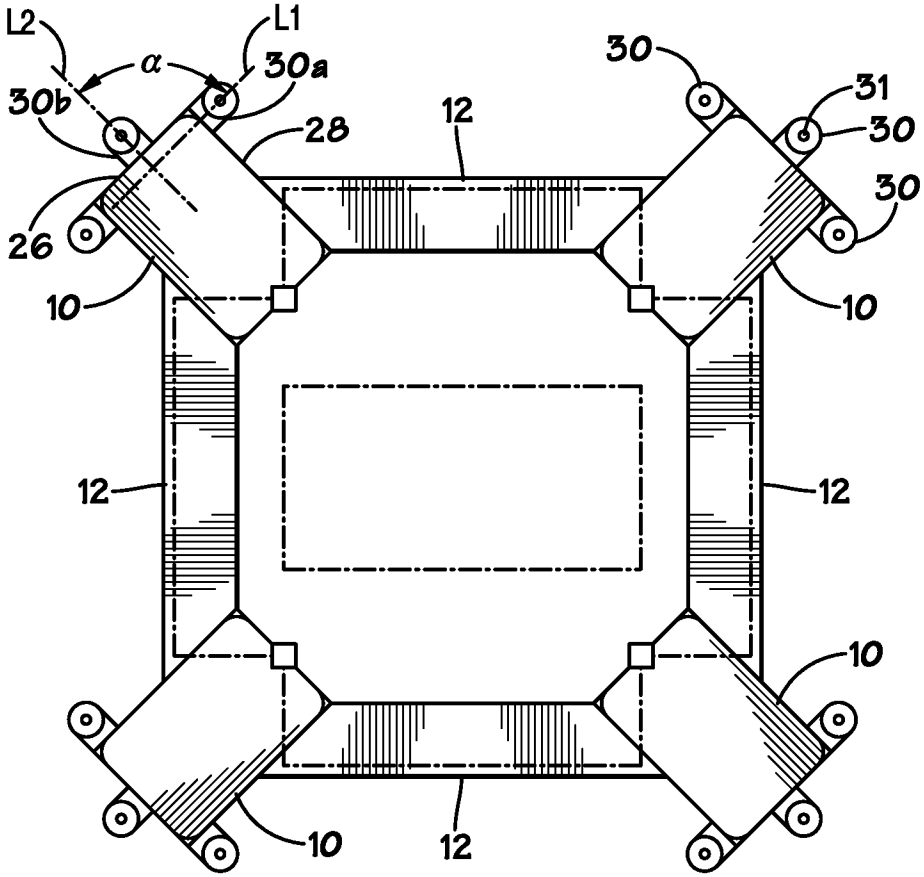
FIG. 14 is the top plan view of FIG. 13B with lines added to show the angle between adjacent tendon porches.

Referring now to FIG. 14, it may be seen that a tension leg platform according to one embodiment of the invention may comprise a plurality of buoyant columns 10 having a polygonal transverse cross section with at least two tendon porches 30 on each column, adjacent tendon porches 30*a* and 30*b* being configured such that a first line L1 normal to the surface 28 of the column on which a first tendon porch 30*a* is mounted and passing through the center of the tendon seat 31 of the first tendon porch lies at an angle $\alpha$ that is greater than zero degrees and less than or equal to 90 degrees to a second line L2 normal to the surface 26 of the column 10 on which an adjacent second tendon porch 30*b* is mounted and passing through the center of the tendon seat of the second tendon porch 30*b* and, a plurality of buoyant pontoons 12 connected between adjacent columns 10.

FIGS. 15A, 15B, 16A and 16B illustrate representative embodiments of the invention having a "rectangular planform." As used herein, a "rectangular planform" is defined as a four-column platform design wherein corresponding points on the columns form a "rectangle"—a parallelogram all of whose angles are right angles and with adjacent sides of unequal length.

Figure 15A:
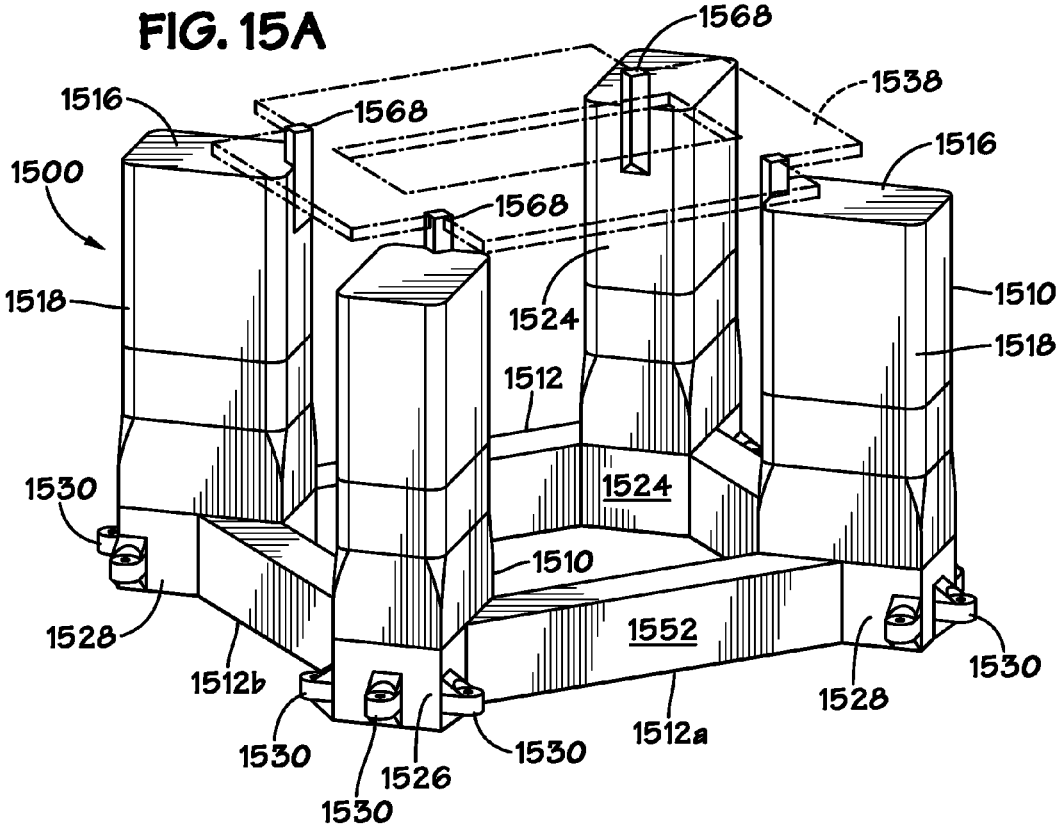
FIG. 15A is an isometric view of a TLP hull according to an eleventh embodiment of the invention.
Figure 15B:
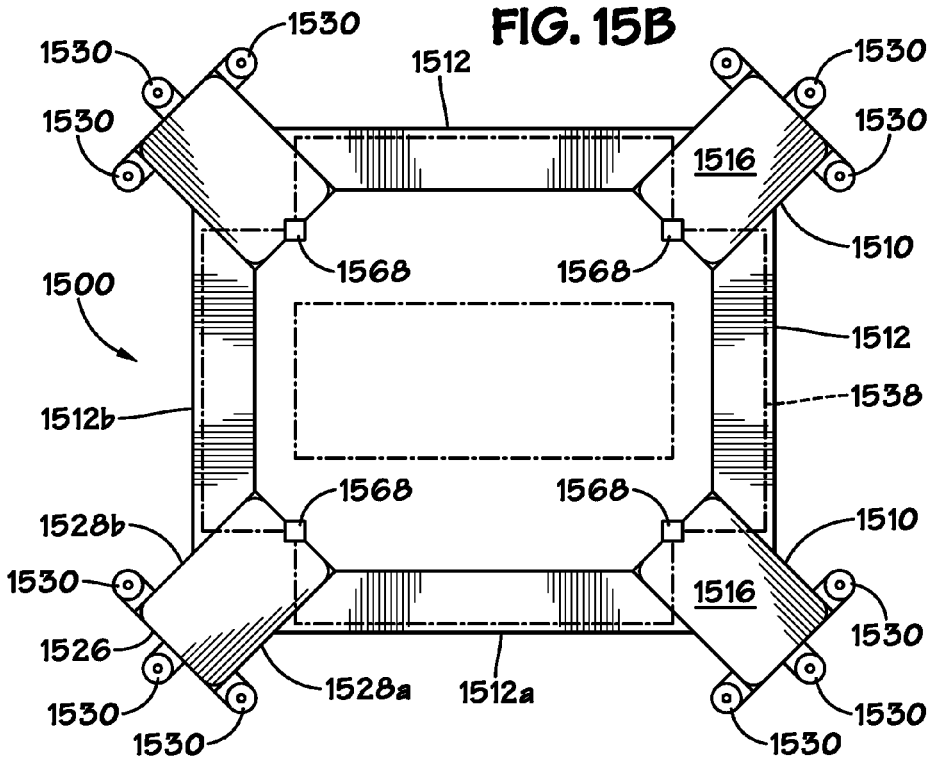
FIG. 15B is a top plan view of the hull illustrated in FIG. 15A.

FIGS. 15A and 15B depict an eleventh embodiment of the invention. TLP hull 1500 has generally rectangular columns 1510 with two, opposing, side surfaces 1528*a* and 1528*b* with outboard surface 1526 and opposing inboard column surface 1524 connected between the side surfaces. Columns 1510 may have curved corner sections 1518 which connect side panels 1528 to outboard panel 1526 and/or inboard panel 1524 which may be generally flat. As shown in the illustrated embodiment, curved corner sections 1518 may be used in the upper portion of columns 1510 while the lower portion has square corners. Curved sections 1518 may have a single radius of curvature, a compound radius of curvature or a generalized curve shape. In the illustrated embodiment, the major axis of the transverse cross section of each column 1510 is disposed at a 45-degree angle to a line connecting the transverse center points of adjacent columns.

A plurality of buoyant pontoons 1512 are connected between adjacent columns 1510, the pontoons having a generally rectangular cross section and an outboard, generally vertical surface 1552 connected to a side surface 1528 of an adjacent column at a location that is inboard of the outboard surface 1526 of column 1510. The inboard surfaces of the pontoons may be flush with the inboard surfaces 1524 of columns 1510. In this embodiment, the pontoons 1512 are comprised of substantially straight sections and the two pontoons connected to each column—e.g., 1512*a* and 1512*b*—are of unequal length.

Tendon porches 1530 may be mounted to one or more of outboard column face 1526 and side surfaces 1528*a* and/or 1528*b* outboard of the juncture of column surface 1528 and pontoon vertical surface 1552. It will be appreciated that a TLP according to the present invention permits tendon porches to be located on adjacent faces of a column when a plurality of tendon porches are connected to a single column.

Figure 16A:
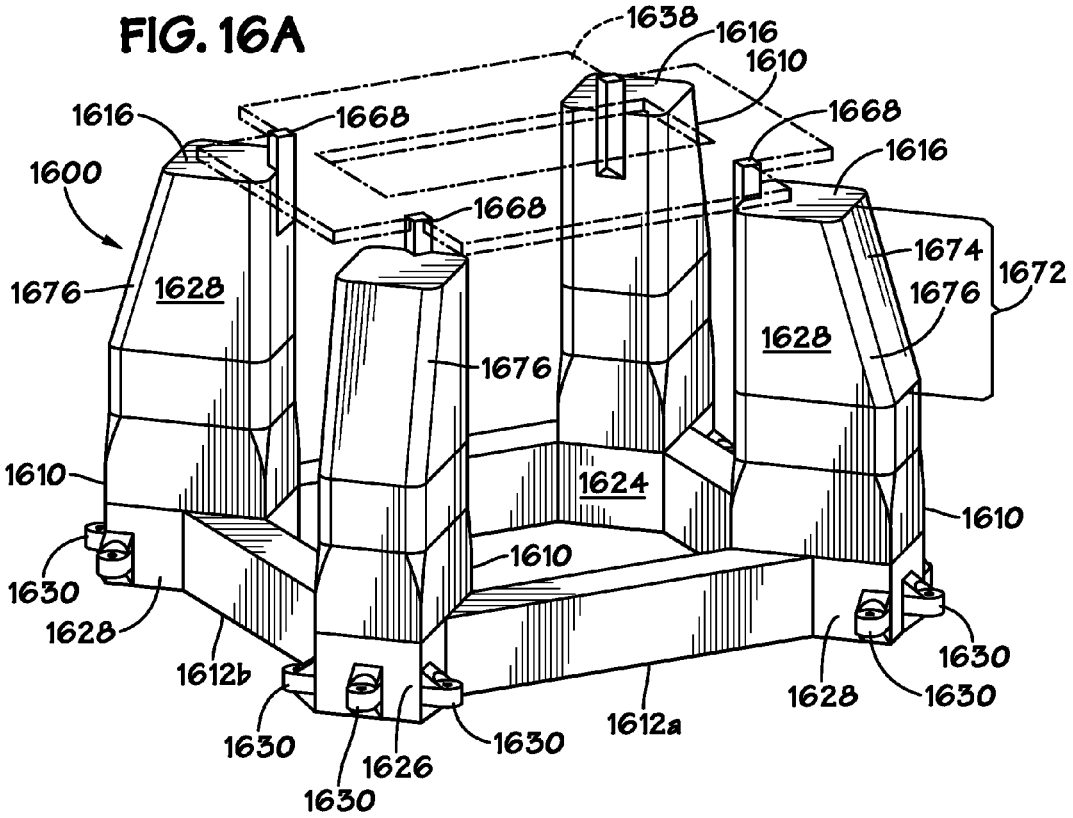
FIG. 16A is an isometric view of a TLP hull according to a twelfth embodiment of the invention.
Figure 16B:
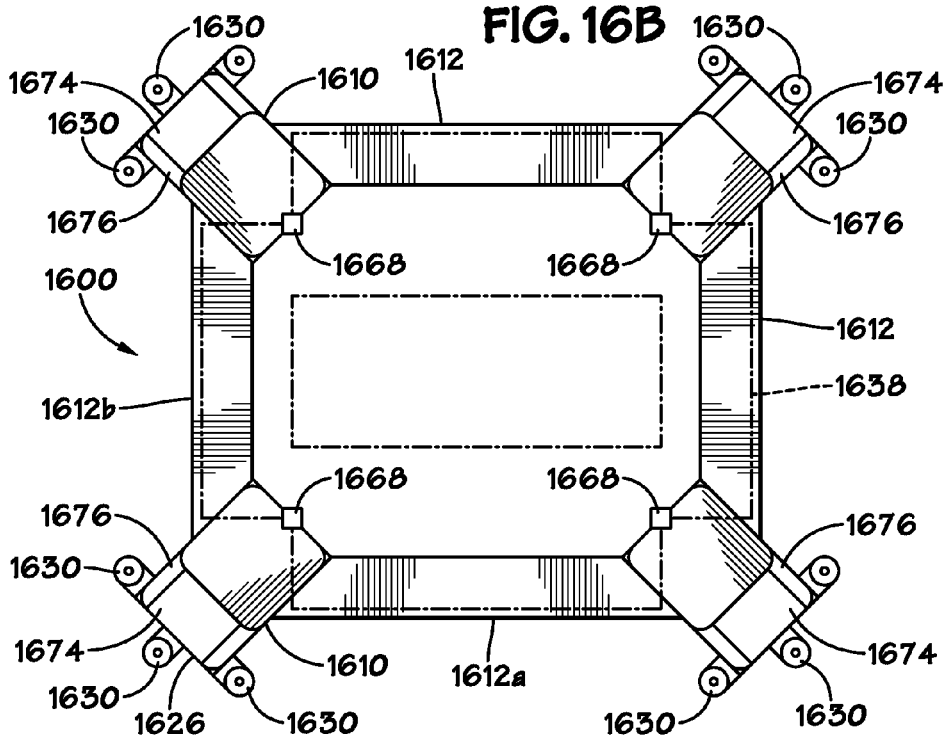
FIG. 16B is a top plan view of the hull illustrated in FIG. 16A.

FIGS. 16A and 16B depict a twelfth embodiment of the invention that has tapered columns. Columns 1610 have portion 1672 wherein the cross sectional area of the column progressively increases with distance from upper surface 1616. Inboard face 1624 of columns 1610 may be substantially the same as inboard face 124 of TLP 100 (as illustrated in FIG. 1) and may be the principal load-bearing member for deck support posts 1668. Outside surface 1674 may be inclined from the vertical and a curved surface 1676 may join outboard surface 1674 and side surface 1628. In the illustrated embodiment, the major axis of the transverse cross section of each column 1610 is disposed at a 45-degree angle to a line connecting the transverse center points of adjacent columns.

In the embodiment shown in FIGS. 16A and 16B, the pontoons 1612 are comprised of substantially straight sections and the two pontoons connected to each column—e.g., 1612*a* and 1612*b*—are of unequal length. The use of tapered columns 1610 may allow TLP hull 1600 to be constructed using less material than that required for the hull of TLP 1500.

It will be appreciated by those skilled in the art that other 4-column embodiments of the invention (including those illustrated in FIGS. 1-14) may also be configured so as to have a rectangular planform.

Figure 17A:
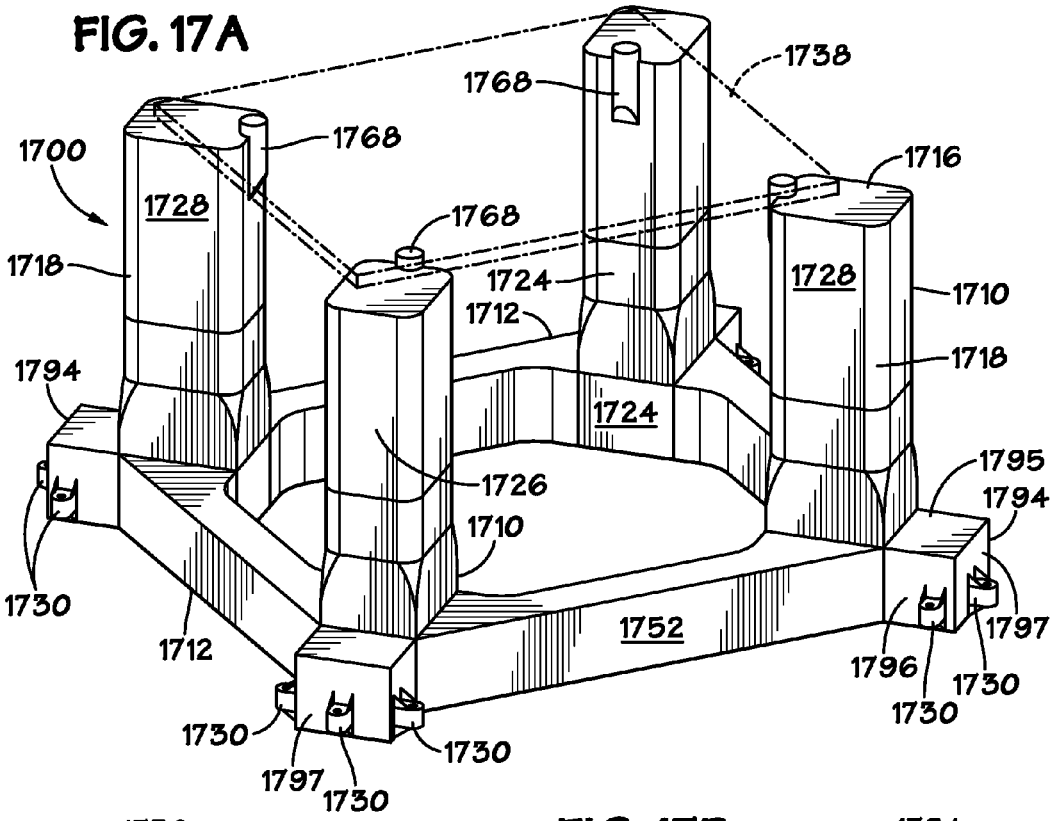
FIG. 17A is an isometric view of a TLP hull according to a thirteenth embodiment of the invention.
Figure 17B:
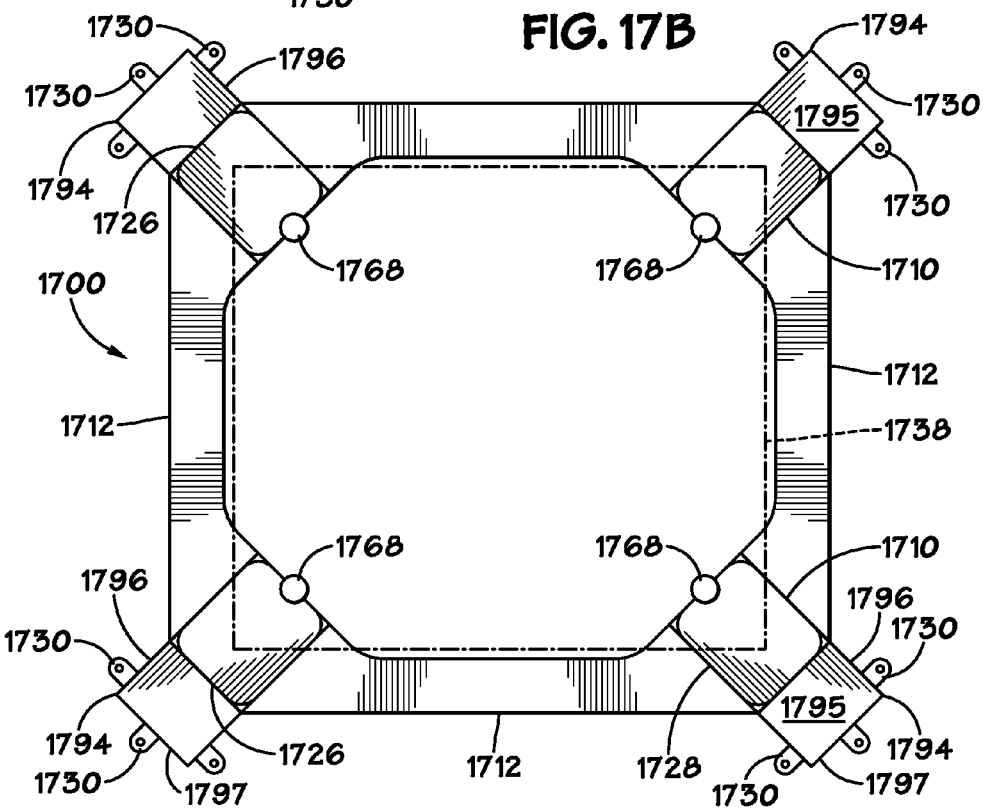
FIG. 17B is a top plan view of the hull illustrated in FIG. 17A.

FIGS. 17A and 17B depict a thirteenth embodiment of the invention. TLP hull 1700 has generally rectangular columns 1710 with two, opposing, side surfaces 1728 with outboard surface 1726 and opposing inboard column surface 1724 connected between the side surfaces. Columns 1710 may have curved corner sections 1718 which connect side panels 1728 to outboard panel 1726 and/or inboard panel 1724 which may be generally flat. As shown in the illustrated embodiment, curved corner sections 1718 may be used in the upper portion of columns 1710 while the lower portion has square corners. Curved sections 1718 may have a single radius of curvature, a compound radius of curvature or a generalized curve shape. In the illustrated embodiment, the major axis of the transverse cross section of each column 1710 is disposed at a 45-degree angle to a line connecting the transverse center points of adjacent columns.

A plurality of buoyant pontoons 1712 are connected between adjacent columns 1710, the pontoons having a generally rectangular cross section and an outboard, generally vertical surface 1752 connected to a side surface 1728 of an adjacent column. The inboard surfaces of the pontoons may be flush with the inboard surfaces 1724 of columns 1710.

In TLP hull 1700, a radial extension 1794 is attached to the lower, outboard portion of each column 1710. In the illustrated embodiment, extensions 1794 are parallelepipeds comprising an upper panel 1795, an opposing pair of side panels 1796 and an outer panel 1797 that together define an enclosed space which may, in certain embodiments, contain ballast and/or buoyancy tanks or house other equipment. In yet other embodiments (not shown), extensions 1794 may comprise an open framework of structural members.

Tendon porches 1730 may be mounted to outboard panel 1797 and/or side panels 1796. It will be appreciated that a TLP according to the present invention permits tendon porches to be located on adjacent faces of a column extension when a plurality of tendon porches are connected to each corner of a hull. Column extensions 1794 permit tendon porches 1730 to be located farther from the central vertical axis of hull 1700 thereby enhancing the stability of the platform.

Although the embodiment of the invention illustrated in FIGS. 17A and 17B has a substantially square planform, other embodiments of the invention equipped with column extensions 1794 may have a substantially rectangular planform—i.e., a planform wherein adjacent sides are of unequal length.

Although particular embodiments of the present invention have been shown and described, they are not intended to limit what this patent covers. Those skilled in the art will understand that various changes and modifications may be made without departing from the scope of the present invention as literally and equivalently covered by the following claims.

What is claimed is:

1. A tension leg platform comprising:

at least four buoyant columns arranged in a rectangular planform with each column having a polygonal transverse cross section with a plurality of substantially flat, exterior surfaces;

at least two tendon porches on each column, adjacent tendon porches being configured such that a first line normal to a first exterior surface of the column on which a first tendon porch is mounted and passing through the center of the tendon seat of the first tendon porch lies at an angle that is greater than zero degrees and less than or equal to 90 degrees to a second line normal to a second exterior surface of the column on which an adjacent second tendon porch is mounted and passing through the center of the tendon seat of the second tendon porch; and, at least one buoyant pontoon connecting adjacent columns.

2. A tension leg platform as recited in claim 1 wherein the columns have a generally rectangular transverse cross section.

3. A tension leg platform as recited in claim 2 wherein the long axis of the generally rectangular transverse cross section of each column is disposed at about 45 degrees to each long axis of the pontoons connected to that column and each column comprises an inboard surface, an outboard surface and a pair of opposing side surfaces and the tendon porches are attached to the outboard surface and at least one of the side surfaces of each column.

4. A tension leg platform as recited in claim 3 wherein the pontoons have a generally rectangular cross section and an outboard, generally vertical surface connected to a side surface of an adjacent column at a location that is inboard of the outboard surface of the column.

5. A tension leg platform comprising:

at least four buoyant surface-piercing columns arranged in a rectangular planform with each column having an inboard surface, an outboard surface, a pair of opposing side surfaces and a generally rectangular transverse cross section whose long axis is disposed at approximately a 45-degree angle to a line between the centers of adjacent columns;

at least one buoyant pontoon connected between adjacent columns, the pontoons having a generally rectangular cross section and an outboard, generally vertical surface connected to a side surface of an adjacent column at a location that is inboard of the outboard surface of the column.

6. A tension leg platform as recited in claim 5 further comprising at least one curved section on the outboard, generally vertical surface of the pontoon proximate a column to which the pontoon is connected.

7. A tension leg platform as recited in claim 6 wherein the curved section is configured such that it provides an approximately orthogonal intersection of the outboard surface of the pontoon and the side surface of the column.

8. A tension leg platform as recited in claim 5 wherein the inboard surfaces of the pontoons are substantially flush with the inboard surfaces of the columns.

9. A tension leg platform as recited in claim 8 wherein the inboard surfaces of the pontoons include at least one curved section between two, non-parallel, substantially straight sections.

10. A tension leg platform as recited in claim 5 wherein the inboard surfaces of the pontoons are inset from the inboard surfaces of the columns.

11. A tension leg platform as recited in claim 10 further comprising a pontoon section attached to the inboard surface of the column which extends between the two opposing side surfaces of the column.

12. A tension leg platform as recited in claim 5 further comprising curved sections between the side surfaces and inboard and outboard surfaces of the columns.

13. A tension leg platform as recited in claim 5 further comprising at least one section of the columns having curved sections between the side surfaces and inboard and outboard surfaces of the column and at least one section of the columns having substantially orthogonal intersections between the side surfaces and the inboard and outboard surfaces of the column.

14. A tension leg platform as recited in claim 5 wherein at least a portion of each column has a transverse cross section of progressively increasing area with distance from the top of the column.

15. A tension leg platform as recited in claim 14 wherein the outboard surface of the column is inclined from the vertical and the inboard and outboard surfaces are substantially vertical.

16. A tension leg platform as recited in claim 5 further comprising at least one tendon porch on the outboard surface of each column and each side surface that is adjacent the outboard surface.

17. A tension leg platform as recited in claim 5 further comprising at least one tendon porch on each side surface of each column and at least one tendon porch on an outboard surface of a pontoon.

18. A tension leg platform as recited in claim 17 wherein the outboard surface of each column is devoid of tendon porches.

19. A tension leg platform as recited in claim 5 further comprising a plurality of tendon porches on the outboard surface of each column and side column surfaces devoid of tendon porches.

20. A semi-submersible comprising:

at least four buoyant surface-piercing columns arranged in a rectangular planform with each column having an inboard surface, an outboard surface, a pair of opposing side surfaces and a generally rectangular transverse cross section whose long axis is aligned with the central vertical axis of the platform;

at least one buoyant pontoon connected between adjacent columns, the pontoons having a generally rectangular cross section and an outboard, generally vertical surface connected to a side surface of an adjacent column at a location that is inboard of the outboard surface of the column.

21. A semi-submersible as recited in claim 20 further comprising at least one curved section on the outboard, generally vertical surface of the pontoon proximate a column to which the pontoon is connected.

22. A semi-submersible as recited in claim 21 wherein the curved section is configured such that it provides an approximately orthogonal intersection of the outboard surface of the pontoon and the side surface of the column.

23. A semi-submersible as recited in claim 20 wherein the inboard surfaces of the pontoons are substantially flush with the inboard surfaces of the columns.

24. A semi-submersible as recited in claim 23 wherein the inboard surfaces of the pontoons include at least one curved section between two, non-parallel, substantially straight sections.

25. A semi-submersible as recited in claim 20 wherein the inboard surfaces of the pontoons are inset from the inboard surfaces of the columns.

26. A semi-submersible as recited in claim 25 further comprising a pontoon section attached to the inboard surface of the column which extends between the two opposing side surfaces of the column.

27. A semi-submersible as recited in claim 20 further comprising curved sections between the side surfaces and inboard and outboard surfaces of the columns.

28. A semi-submersible as recited in claim 20 further comprising at least one section of the columns having curved sections between the side surfaces and inboard and outboard surfaces of the column and at least one section of the columns having substantially orthogonal intersections between the side surfaces and the inboard and outboard surfaces of the column.

29. A semi-submersible as recited in claim 20 wherein at least a portion of each column has a transverse cross section of progressively increasing area with distance from the top of the column.

30. A semi-submersible as recited in claim 29 wherein the outboard surface of the column is inclined from the vertical and the inboard and outboard surfaces are substantially vertical.

31. A semi-submersible drilling rig comprising:

a hull comprised essentially of four buoyant columns arranged in a rectangular planform with each column having an inboard surface, an outboard surface, a pair of opposing side surfaces and a generally rectangular transverse cross section at the nominal waterline whose long axis is aligned with the central vertical axis of the platform;

at least one buoyant pontoon connected between adjacent columns, the pontoons having a generally rectangular cross section and an outboard, generally vertical surface connected to a side surface of an adjacent column at a location that is inboard of the outboard surface of the column; and, a deck supported upon the columns above the water.

32. A semi-submersible drilling rig as recited in claim 31 further comprising at least one curved section on the outboard, generally vertical surface of the pontoon proximate a column to which the pontoon is connected.

33. A semi-submersible drilling rig as recited in claim 32 wherein the curved section is configured such that it provides an approximately orthogonal intersection of the outboard surface of the pontoon and the side surface of the column.

34. A semi-submersible drilling rig as recited in claim 31 wherein the inboard surfaces of the pontoons are substantially flush with the inboard surfaces of the columns.

35. A semi-submersible drilling rig as recited in claim 34 wherein the inboard surfaces of the pontoons include at least one curved section between two, non-parallel, substantially straight sections.

36. A semi-submersible drilling rig as recited in claim 31 wherein the inboard surfaces of the pontoons are inset from the inboard surfaces of the columns.

37. A semi-submersible drilling rig as recited in claim 36 further comprising a pontoon section attached to the inboard surface of the column which extends between the two opposing side surfaces of the column.

38. A semi-submersible drilling rig as recited in claim 31 further comprising curved sections between the side surfaces and inboard and outboard surfaces of the columns.

39. A semi-submersible drilling rig as recited in claim 31 further comprising at least one section of the columns having curved sections between the side surfaces and inboard and outboard surfaces of the column and at least one section of the columns having substantially orthogonal intersections between the side surfaces and the inboard and outboard surfaces of the column.

40. A semi-submersible drilling rig as recited in claim 31 wherein at least a portion of each column has a transverse cross section of progressively increasing area with distance from the top of the column.

41. A semi-submersible drilling rig as recited in claim 40 wherein the outboard surface of the column is inclined from the vertical and the inboard and outboard surfaces are substantially vertical.

42. A semi-submersible drilling rig as recited in claim 31 further comprising a plurality of azimuthal thrusters attached to the hull and controlled by a dynamic positioning system.

43. A tension leg platform comprising:

at least four, buoyant, 5-sided, surface-piercing columns configured in a rectangular planform with each column having two, generally orthogonal side surfaces and three, adjacent outboard surfaces connected between the side surfaces;

at least one buoyant pontoon connected between adjacent columns, the pontoons having a generally rectangular cross section and an outboard, generally vertical surface connected to a side surface of an adjacent column at a location that is inboard of the outboard surfaces of the column.

44. A tension leg platform as recited in claim 43 wherein the middle of the three outboard surfaces of each 5-sided column is generally orthogonal to a line connecting the midpoint of the transverse cross section of the middle outboard surface to the central vertical axis of the platform.

45. A tension leg platform as recited in claim 44 further comprising a tendon porch on each of the three, adjacent, outboard surfaces of each column.

46. A tension leg platform comprising:

at least four buoyant columns arranged in a rectangular planform with each column having an inboard surface, an outboard surface, a pair of opposing side surfaces and a generally rectangular transverse cross section at the nominal waterline whose long axis is disposed at approximately a 45-degree angle to a line between the centers of adjacent columns;

a generally box-shaped column extension attached to the outboard surface of each column with each extension having an outer panel adjacent to an opposing pair of side panels;

at least one tendon porch attached to the outer panel of each column extension;

at least one tendon porch attached to each side panel of each column extension; and, at least one buoyant pontoon connected between adjacent columns.

47. A tension leg platform as recited in claim 46 wherein the buoyant pontoon connected between adjacent columns has a generally rectangular cross section and a substantially vertical inboard surface.

48. A tension leg platform as recited in claim 47 wherein the inboard surface of the pontoon is substantially flush with the inboard surfaces of the columns to which it is connected.

49. A tension leg platform as recited in claim 48 wherein the inboard surface of the pontoon includes at least one curved section between two, non-parallel, substantially straight sections.

50. A tension leg platform as recited in claim 46 further comprising a ballast tank within a column extension.

51. A tension leg platform as recited in claim 46 further comprising a buoyancy compartment within a column extension.

52. A tension leg platform comprising:

at least four buoyant columns arranged in a substantially square planform with each column having an inboard surface, an outboard surface, a pair of opposing side surfaces and a generally rectangular transverse cross section at the nominal waterline whose long axis is disposed at approximately a 45-degree angle to a line between the centers of adjacent columns;

a generally box-shaped column extension attached to the outboard surface of each column with each extension having an outer panel adjacent to an opposing pair of side panels;

at least one tendon porch attached to the outer panel of each column extension;

at least one tendon porch attached to each side panel of each column extension; and, at least one buoyant pontoon connected between adjacent columns.

53. A tension leg platform comprising:

at least four buoyant columns with each column having an inboard surface, an outboard surface, a pair of opposing side surfaces and a generally rectangular transverse cross section whose long axis is disposed at approximately a 45-degree angle to a line between the centers of adjacent columns;

a column extension consisting essentially of an open framework of structural members and attached to the outboard surface of each column with each extension having an outboard side and an opposing pair of substantially vertical sides adjacent to the outboard side;

at least one tendon porch attached to the outboard side of each column extension;

at least one tendon porch attached to each substantially vertical side adjacent to the outboard side of each column extension; and, at least one buoyant pontoon connected between adjacent columns.

* * * * *